US010219628B2

(12) United States Patent
Reinhard

(10) Patent No.: US 10,219,628 B2
(45) **Date of Patent: *Mar. 5, 2019**

(54) OFFICE, WORK AND LEISURE CHAIR AND RETROFIT KIT FOR A CHAIR OR A SEAT SURFACE FOR CAUSING SUBLIMINAL MOVEMENTS OF THE PERSON SITTING THEREON

(71) Applicant: iii solutions GmbH, Baar (CH)

(72) Inventor: Andreas Reinhard, Baar (CH)

(73) Assignee: iii solutions GmbH, Baar (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/499,063

(22) Filed: Apr. 27, 2017

(65) Prior Publication Data

US 2017/0290432 A1 Oct. 12, 2017

(30) Foreign Application Priority Data

Oct. 28, 2014 (CH) ..... 1657/14

(51) Int. Cl.
*A47C 7/14* (2006.01)
*A47C 9/00* (2006.01)
(Continued)

(52) U.S. Cl.
CPC ..... *A47C 7/14* (2013.01); *A47C 3/22* (2013.01); *A47C 7/025* (2013.01); *A47C 7/34* (2013.01);
(Continued)

(58) Field of Classification Search
CPC .... A47C 7/14; A47C 3/22; A47C 7/34; A47C 7/35; A47C 7/44; A47C 7/462; A47C 9/002; A47C 9/02; A47C 31/008
See application file for complete search history.

(56) References Cited

U.S. PATENT DOCUMENTS 5,769,492 A * 6/1998 Jensen ..... A47C 9/002 297/188.09
5,976,097 A * 11/1999 Jensen ..... A47C 7/024 297/330
(Continued)

FOREIGN PATENT DOCUMENTS

DE 35 13 985 A1 10/1986
DE 299 00 747 U1 4/1999
(Continued)

OTHER PUBLICATIONS

International Search Report with translation for PCT/IB2015/058315, dated Feb. 10, 2016.
(Continued)

*Primary Examiner* — Philip F Gabler
(74) *Attorney, Agent, or Firm* — Sughrue Mion, PLLC

(57) ABSTRACT

An office, work and leisure chair and retrofit kit for subliminal motions of the seated person. The chair has a cruciform base (1) with rollers (4), a pneumatic spring-action post (2) with an interface plate (5) for a seat panel (21) and seat pad (19), and a backrest (22). The seat panel is mounted with wobble capability on a pneumatic cushion, which has deformable air chambers (18, 35) connected by connecting hoses (27) and lies on an elastically deformable hollow body (14). The hollow body pumps the air chambers when a person sits down and stands up. A pump hose (12) with a one-way valve leads from the hollow body to compensate for leakage losses. Connecting hoses between the air chambers have valves (31; 75; 89) such that the wobbling distance of the seat panel and the damping of the wobbling motion is variable.

20 Claims, 13 Drawing Sheets

(51) Int. Cl.

| | |
|---|---|
| ***A47C 3/22*** | (2006.01) |
| ***A47C 7/02*** | (2006.01) |
| ***A47C 7/44*** | (2006.01) |
| ***A47C 7/46*** | (2006.01) |
| ***A47C 9/02*** | (2006.01) |
| ***A47C 31/00*** | (2006.01) |
| ***A47C 31/12*** | (2006.01) |
| ***A47C 7/34*** | (2006.01) |
| ***A47C 7/35*** | (2006.01) |

(52) U.S. Cl.
CPC ..... *A47C 7/35* (2013.01); *A47C 7/44* (2013.01); *A47C 7/462* (2013.01); *A47C 9/002* (2013.01); *A47C 9/02* (2013.01); *A47C 31/008* (2013.01); *A47C 31/126* (2013.01)

(56) References Cited

U.S. PATENT DOCUMENTS

| | | | | |
|---|---|---|---|---|
| 6,413,194 | B1 * | 7/2002 | Gant | A47C 7/021 482/112 |
| 9,016,786 | B2 * | 4/2015 | Glockl | A47C 3/22 297/313 |
| 2008/0079301 | A1 | 4/2008 | Schaaf | |
| 2014/0054941 | A1 * | 2/2014 | Meyer | A47C 7/14 297/313 |
| 2017/0136294 | A1 * | 5/2017 | Piksa | A47C 7/021 |
| 2017/0290433 | A1 * | 10/2017 | Reinhard | A47C 7/14 |

FOREIGN PATENT DOCUMENTS

| | | | |
|---|---|---|---|
| DE | 29900747 | U1 | 4/1999 |
| DE | 10 2005 033 052 | A1 | 2/2007 |
| DE | 102005033052 | | 2/2007 |
| FR | 1 305 406 | A | 10/1962 |
| WO | 2007/105960 | A1 | 9/2007 |
| WO | WO2007105960 | A1 | 4/2008 |

OTHER PUBLICATIONS

International Preliminary Report on Patentability with translation for PCT/IB2015/058315, dated May 2, 2017.

International Search Report with translation for PCT/IB2015/058317, dated Feb. 24, 2016.

International Preliminary Report on Patentability with translation for PCT/IB2015/058317, dated May 2, 2017.

* cited by examiner

OFFICE, WORK AND LEISURE CHAIR AND RETROFIT KIT FOR A CHAIR OR A SEAT SURFACE FOR CAUSING SUBLIMINAL MOVEMENTS OF THE PERSON SITTING THEREON

The present invention pertains to an office, work or leisure chair that provides significantly improved sitting comfort, particularly for prolonged sitting periods, in that it stimulates passively induced, subliminal dampened movements of the person sitting thereon by means of a functional and user-defined mechanism that is activated pneumatically. On the other hand, the invention also pertains to a retrofit kit for being installed on an existing chair or any seat pad or seat surface in order to cause subliminal movements of the person sitting thereon.

In light of the fact that sitting is a relatively modern phenomenon for people, namely for working people, and in principle did not have a widespread impact until the emergence of the service industry and the introduction of computers, sitting as a body posture has gained increased significance and correspondingly affects the public health due to the very large number of people, who nowadays spend their workdays in a seated position. In Germany, a total of 4 billion chairs are distributed over a population of approximately 80 million, wherein this ratio approximately corresponds to 50 chairs per citizen. The chair as a product therefore proves to be an essential object that is familiar to every person and, due to its exceptionally extensive use alone, should provide maximum comfort and promote the well-being and the physical health of the respective user.

A scientific study published in the *American Journal of Physiology* of the University of Tel Aviv confirms that the human body accumulates fat in greater quantities and faster at locations that are regularly subjected to pressure and/or tension. In laboratory tests, adipocytes (fat cells) were purposefully subjected to mechanical stress in order to simulate prolonged sitting. High-tech microscopy was used in order to investigate how the adipocytes changed under the influence of mechanical pressure. The lipid droplets agglutinated and became larger and firm. It can therefore be concluded that the static pressure during prolonged sitting promotes the fat accumulation on the buttocks and thighs. In contrast, the size of the adipocytes could be reduced by means of cyclic extension.

The prior art includes a plurality of chair constructions, namely office, work and leisure chair constructions, all of which strive to optimize the sitting comfort and to simultaneously allow healthy sitting. The typical office, work and leisure chair has a running gear with multiple legs that radially protrude from the post in a star-shaped fashion or a horizontal ring, on which rollers are mounted rotatably about an additional vertical axis such that the chair can basically be rolled in all directions. The typical office, work and leisure chair furthermore has a stable seat surface that is mounted on the running gear rotatably about a vertical axis and can be adjusted with respect to its height, but is in itself stationary. The buttocks and the back of a seated person are hardly moved on such a chair, wherein this is detrimental to the blood circulation and last but not least also the well-being. Office chairs are furthermore equipped with backrests and frequently also with armrests. The control elements for adjusting the seat height, the incline of the backrest, the height of the armrests, etc., are all located underneath the seat surface and the corresponding levers are not visible while being seated on the chair.

An ergonomic office, work and leisure chair model is disclosed, for example, in DE 10 2005 033 052 A1. This publication discloses seating furniture, the seat surface of which lies on a tilting device. A locking device in the form of an air cushion is formed by an annular tube and assigned to this tilting device in such a way that the tilting angle of the tilting motions can be adjusted by means of the air cushion. One potential embodiment comprises multiple air cushions that can be pumped up individually in order to limit or deactivate the tilting motions. A hand lever arranged underneath the seat surface enables the seated person to inflate the air cushion by means of an air pump or to discharge the air contained therein by means of a ventilation valve that is likewise arranged underneath the seat surface.

A similar configuration is known from the therapeutic seat assembly disclosed in US 2008/0079301 A1. This publication describes a device for enhancing the proprioception and the core health, particularly for persons with neuromuscular diseases such as cerebral palsy or scoliosis. The engineering of this system is configured similar to that known from [0005] with a supporting structure, a motion control unit and a seat pad. Two axes extending perpendicular to one another, about which the seat pad is rotatably mounted, are defined by the design of the device. In order to dampen these motions, this publication also discloses a damping device consisting of an inflatable annular element. The air volume contained in this element can be regulated with the aid of a pump and a discharge valve arranged underneath the seat pad. However, the device disclosed in this publication has a very complex design with a plurality of individual elements for realizing variable dampened tilting motions of the person seated on the chair.

Furthermore, WO 2007/105960 A1 discloses a seat assembly with centrally supported seat pad. Either two or four air cushions, which are respectively arranged opposite or orthogonal to one another about the central support, are positioned underneath this seat carrier and connected to one another in such a way that air can be exchanged between said air cushions in order to realize a damping adjustment definable along the rotational axes.

The aforementioned documents essentially form the prior art with respect to a pneumatic realization of mobility while sitting. In summary, a person seated on such a seat assembly can carry out superimposed tilting motions about two axes which are dampened by means of air cushions. In this case, the person in question can respectively regulate the air volume or the pressure manually by means of a pump and a valve that can be actuated underneath the seat pad. However, these solutions actually do not lead to satisfactory sitting habits. Numerous studies confirm that persons who remain in a seated position over a prolonged period of time are extremely sluggish and hardly ever change the seat adjustment. In fact, such a person will adjust the degree of damping of the air cushions disclosed in the aforementioned documents only once and then become accustomed to the respective tilting degree. The motion activity of a person already decreases markedly or completely ceases shortly after the person sits down on the chair. The body naturally attempts to prevent the tilting motions, however, without the direct awareness of the seated person. The inherent sluggishness of people inhibits them from carrying out unnecessary motions. In addition, a person who works in an office and spends the entire workday seated on an office, work or leisure chair hardly will systematically carry out different adjustments of this chair. Once seated in a position that is perceived as a comfortable, the worker will not risk changing this position to a less comfortable position. In light of the work activity, such a worker furthermore would not even consider changing the seat adjustment. Even the broadest assortment of variable precision adjustments cannot prevent this inactivity due to the inevitable lack of initiative.

The present invention therefore is based on the objective of disclosing an office, work and leisure chair for stimulating subliminal movements and for this purpose proposes a new approach for realizing the attributes defined in [0001], particularly the mechanical-biological stimulation for long-term healthy sitting. The chair should elevate sitting to a completely new level and cause a change from inactive sitting to inevitably dynamic, stimulating sitting that also promotes the blood circulation in the body tissues of the buttocks, the back and the thighs. The inactivity of the pelvic region compelled by currently available office chairs should be replaced with a natural and inevitably or unavoidably occurring pelvic motion in order to keep the entire musculature active in the region of the buttocks and the pelvis, as well as indirectly also in the back region. This pelvic motion leads to a coupled motion of the spinal column in that torsional forces and bending forces act thereupon, primarily in the region of the lumbar vertebrae.

The office, work and leisure chair should inevitably induce the motions of the seated persons subliminally by means of adaptive load-dependent kinematics such that the seated person is generally or selectively not aware of this inducement and the person's concentration is therefore not impaired. Consequently, the person should constantly and unavoidably carry out subliminal motions. This type of unavoidable and subliminal active sitting should increase the working concentration above the average level. The inducement of these subtle motions should therefore be ensured with reliable means that do not fail in light of the performance or other mental stresses of the respective person. The cited objectives should thereby be attained persistently and permanently.

The office, work and leisure chair should optionally correspond to a customizable user profile, the adjustment options of which also can be actually and regularly used. The office, work and leisure chair should be an indirectly active chair rather than a stationary structure, but still usable largely autonomous of artificial energy sources, in some embodiments even completely autonomous and therefore anywhere.

This objective is attained with an office, work and leisure chair for causing subliminal motions of the person sitting thereon, featuring a cruciform base with freely articulated rollers, at least one pneumatic spring-action post with an interface plate for the seat panel and its seat pad resting thereon, as well as a backrest, wherein said office, work and leisure chair is characterized in that the seat panel is mounted with wobble capability on a pneumatic wobble cushion, which comprises multiple deformable air chambers that are connected to one another by means of connecting hoses and lies on an elastically deformable hollow body, wherein said hollow body acts as a pump for pumping up the air chambers every time a person sits down on the chair and once again fills with air due to its elastic expansion every time a person stands up from the chair, wherein a pump hose with a one-way valve leads from the hollow body into at least one of the air chambers in order to compensate for any leakage losses, and wherein connecting hoses between the air chambers are equipped with valves that open in a mechanically, hydraulically, pneumatically or electrically metered fashion such that the wobbling distance of the seat panel, as well as the damping of the wobbling motion, is variable.

The above-defined objective is furthermore attained with a retrofit kit for being installed on the non-wobbling seat surface of a conventional chair or on any seat surface and for thereby causing subliminal motions of the person sitting on the retrofit kit, wherein said retrofit kit is characterized in that it comprises a seat panel, which is mounted with wobble capability in that it rests on multiple deformable air chambers that are connected to one another by means of connecting hoses and rest on an elastically deformable hollow body circularly about the center of the seat panel, wherein said hollow body acts as a pump for pumping up the air chambers every time a person sits down on the chair and once again fills with air due to its elastic expansion every time a person stands up from the chair, wherein a pump hose with a one-way valve leads from the hollow body into at least one of the air chambers in order to compensate for any leakage losses, wherein the connecting hoses between the air chambers are equipped with valves that can be opened and closed in a mechanically, hydraulically, pneumatically or electrically metered fashion such that the wobbling distance of the seat panel, as well as the damping of the wobbling motion, is variable, and wherein the bottom plate of the hollow body is mounted on a base plate that can be attached to a seat surface of a conventional office, work and leisure chair or to any seat surface.

Other optional embodiments of the office, work and leisure chair and of the retrofit kit fulfill additional important functions. Exemplary embodiments of this chair and the retrofit kit, as well as their functions, are described and explained below with reference to the drawings.

In these drawings.

Figure 1:
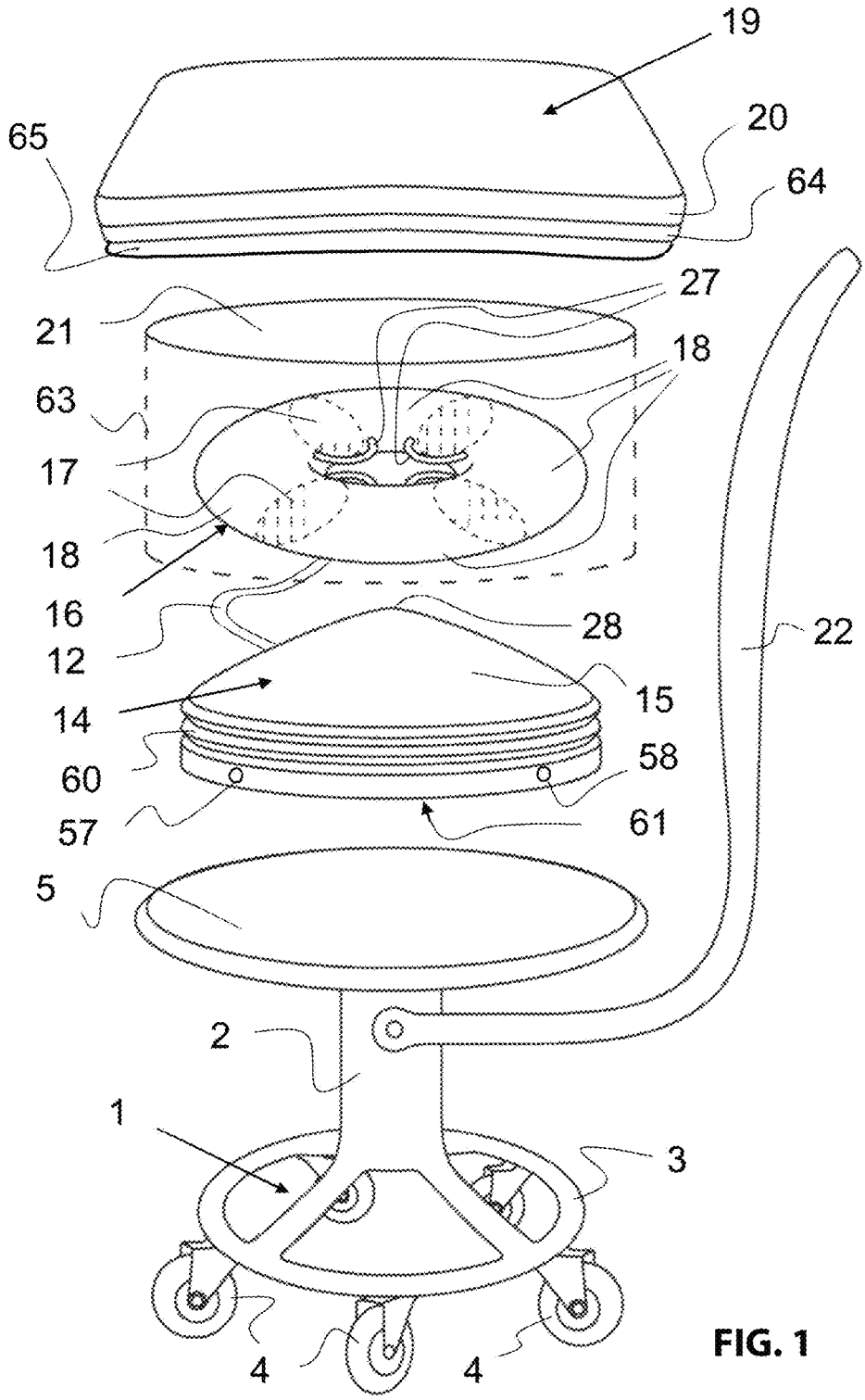
FIG. 1 shows an exploded view of the essential components of an office, work and leisure chair that has a wobble-action seat surface due to a pneumatic annular tube with compartments.

The design of such an office, work and leisure chair for causing subliminal motions of the seated person can be gathered from FIG. 1, in which this chair is illustrated in the form of an exploded view that shows its essential components in greater detail. A cruciform base 1 is illustrated on the very bottom and a pneumatic spring-action post 2 is arranged thereon centrally in this case, but may also be laterally offset, for example, completely rearward underneath the backrest 22 of the office, work and leisure chair in order to keep the area underneath the seat surface 19 clear. The height of the pneumatic spring-action post 2 can be conventionally adjusted with the aid of the pneumatic spring. The cruciform base 1 may be formed by a star-shaped roller assembly with five or more arms, on the ends of which a freely articulated roller 4 is respectively mounted. In the example shown, the cruciform base 1 downwardly transforms into a continuous ring 3, on which a number of freely articulated rollers 4 are mounted. This ensures that the office, work and leisure chair can be very easily rolled in all directions with minimal resistance. A carrier plate in the form of an interface plate 5 is illustrated on top of the pneumatic spring-action post 2 of the cruciform base 1, wherein all components for realizing the wobble capability of the seat surface are arranged on this interface plate. A chair mechanism may also be arranged underneath this interface plate 5 such that the interface plate 5 on this chair mechanism can be displaced forward and backward on the pneumatic spring-action post 2. The bottom plate 61 of a hollow body 14 of plastic rests on top of the interface plate 5. The hollow body 14 has a bellows-like connection 60 with its conical upper side 15, wherein this cone may be realized with a much larger angle at its point than shown such that the height of the cone only measures approximately 2 cm. The top of the hollow body 14 may be realized plane, but a conical shape proves particularly advantageous as described below. The hollow body 14 is equipped with a one-way valve 57 such that it can take in air from the surroundings. Another one-way valve acting in the opposite direction leads into the hose ring 16 lying above the hollow body 14 via a hose 12. The hollow body 14 is also equipped with a pressure control valve 58. The conical upper side 15 of the hollow body 14 is axially pressed toward the bottom plate 61 every time a person sits down on the chair such that the bellows-like connection 60 is elastically folded together until the conical upper side 15 rests on the bottom plate 61 with its edge as elucidated further below. In this case, the hollow body 14 acts as a pump and pumps air into the hose ring 16 through the connecting hose 12 due to the reduction of its volume. Vice versa, the elastic bellows connection 60, which acts as a spring, once again pushes the conical upper side 15 of the hollow body 14 upward into its starting position and thereby raises all elements resting on top thereof when a person stands up from the chair. Due to the expansion of the hollow body volume and the negative pressure forming in its interior as a result thereof, air from the surroundings flows into its interior via the one-way valve 57 such that the hollow body 14 is filled for a subsequent pumping motion. The pressure control valve 58 in the hollow body 14 limits the pressure to a maximum value.

One or more air cushions, which form a wobble cushion with at least one air chamber, rest on top of the conical upper side 15. In the example shown, the wobble cushion is formed by a hose ring 16 realized similar to an inflatable life preserver or an inner tube. This hose ring 16 comprises four partition walls 17 in the example shown and is thereby divided into four compartments 18 in the form of air chambers. The hose ring 16 is centered and held on the cone due to the more or less pronounced conical shape of the hollow body 14. This is precisely why a conical shape is particularly advantageous in this respect. Four hose connections 27 are illustrated in the center of the hose ring 16. Each of these four hose connections 27 respectively connects two adjacent compartments 18 and protrudes toward the center into the region that remains open in the center hose ring 16 in the form of an arc. These hose connections 27 serve for either blocking or allowing a metered air exchange between these compartments 18 in cooperation with special valves as described in greater detail further below. When the hose ring 16 rests on the hollow body 14, a seat panel 21 is attached to the hose ring such that it subsequently rests on an annular supporting surface formed by the hose ring 16.

The entire construction consisting of the interface plate 5, the hollow body 14 and the hose ring 16 is covered on the chair by means of an apron 63 that is indicated with broken lines and protrudes downward from the seat panel 21, wherein this apron protrudes beyond the interface plate 5 by a certain distance in the assembled state of the chair such that the entire construction for realizing the wobble capability of the seat panel 21 is concealed, namely even at a maximal wobbling inclination of the seat panel 21. If so required, the apron 63 has a vertical slot on its rear side opposite of the backrest 22 attached to the pneumatic spring-action post 2 or the interface plate 5 in order to provide a passage for mounting the backrest. For example, the apron 63 may consist of a rigid or flexible metal or plastic shroud. It may be covered with a textile or another suitable material such that it also fulfills a decorative function.

The seat pad 19 forming the actual seat cushion is immovably attached to the top of the seat panel 21. This seat pad 19 is composed of two or more layers similar to a laminate and comprises a supporting plate 65 followed by a lower supporting layer 64 consisting of a flexible material, wherein an upper supporting layer 20 rests on and is realized harder than the lower supporting layer 64. The seat pad 19 may be composed of even more layers. It is important that a harder layer upwardly follows a softer layer although a softer layer may once again be provided on the very top. This seat pad 19 can be attached to the seat panel 21 in a precisely fitted fashion, for example, in that its bottom has a circular recess that precisely fits on the seat panel 21. In this assembled state of the described elements, the chair with its seat panel 21 and seat pad 19 therefore is capable of wobbling, namely in all directions, due to the air-filled hose ring 16 that respectively acts as a wobble cushion or air chamber. However, the wobble capability can be controlled as described further below.

Figure 2:
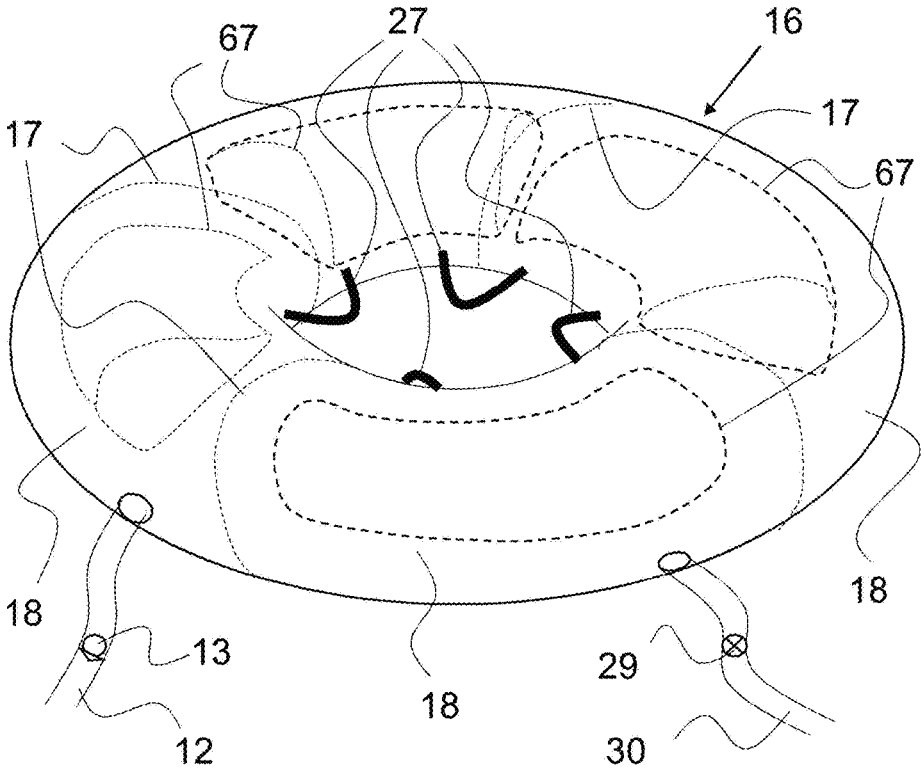
FIG. 2 shows a wobble cushion in the form of a hose ring with four compartments, wherein adjacent compartments are respectively connected by means of a hose.

FIG. 2 shows such a hose ring 16 in the form of a wobble cushion with air chambers, wherein this hose ring comprises four radially extending partition walls 17 in order to respectively form four compartments 18 or air chambers, and wherein adjacent compartments or air chambers are respectively connected by means of a hose 27. These four hose sections 27 protrude into the remaining free space in the center of the hose ring 16 by a certain distance. The four hose sections 27 can be collectively closed to a greater or lesser extent by means of a respective pinch valve or even entirely closed by being completely clamped shut in order to limit the wobble capability of the seat surface and regulate its damping. The compartments 18 or at least one of these compartments is connected to a controllable discharge valve 29 by means of a hose 30 such that air can be discharged therefrom in a controlled fashion. The discharge valve 19 may consist, for example, of a screw-type valve or simply of a valve of the type conventionally used on an inner tube in order to respectively discharge air from the wobble cushion 16 or the air chambers into the surroundings in a metered fashion when the wobble capability should be enhanced or, e.g., a person who weighs less wants to use the chair. As an alternative, the discharge valve 29 can be actuated with a push-pull cable system or a Bowden cable. Such a push-pull cable system includes a single cable that allows a pulling or pushing action or two oppositely moving cables that can be continuously moved in both directions by means of a lever or a turning handle and locked in any adjusted position. A hydraulic or pneumatic adjustment could also be realized as an alternative to these adjustment options. In this case, hydraulic lines or pneumatic hose pipes lead to small piston-cylinder units that actuate the valves by retracting or extending the piston. It is ultimately also conceivable to realize an electric variation, in which the push-pull cables are actuated by electric motors at the push of a button and subsequently actuate the valves. However, this variation would require an energy storage device in the form of a battery.

As already mentioned above, a supply hose 12 leads from the hollow body 14 into the hose ring 16, wherein this supply hose 12 is equipped with a one-way valve 13 such that air can only flow from the hollow body 14 into the hose ring 16, but not in the opposite direction. Since the hose ring 16 suffers a certain unavoidable although minimal air loss, this air loss is continuously compensated by the hollow body 14 acting as a pump. The air pressure in the wobble cushion or hose ring 16 is increased and pumped up to a maximum, which is defined by a pressure control valve in the hose ring 16, every time a person sits down on the chair. Consequently, this chair manages without external energy—such as, for example, without an electrical connection—and its controllable wobble capability is preserved for prolonged periods of time, i.e. for years.

The wobble capability is very limited and hardly noticeable when the wobble cushion is firmly inflated, i.e. when the hose ring 16 is firmly inflated, namely even if a heavy person sits on the chair. When the wobble cushion 16 contains less air, the wobble capability becomes more pronounced and an inclination in any direction is possible up to a maximum inclination defined by a limit stop. For this purpose, special inserts are respectively installed in the interior of the individual cushions or in the interior of the compartments 18 of the hose ring 16. These inserts are specially shaped such that the seat panel 21 comes to rest on these internal inserts in a precisely fitted fashion when the seat panel 21 is inclined to its maximum on one of its sides, wherein said inserts then in turn come to rest on the conical upper side 15 of the hollow body 14 in a precisely fitted fashion. These inserts are illustrated in FIG. 2. They consist of foam bodies 67 or moulded bodies with open or closed pores, the outermost layer of which has a certain softness such that the respective interior of the wobble cushion or the compartments 18 or air chambers cannot be damaged. If the wobble cushion or the hose ring 16 would no longer contain any air after a prolonged period of time due to the lack of pressure accumulation or due to a leak, the seat panel 21 would be lowered on these foam bodies or moulded bodies and the chair could still be used without suffering damage.

Figure 3:
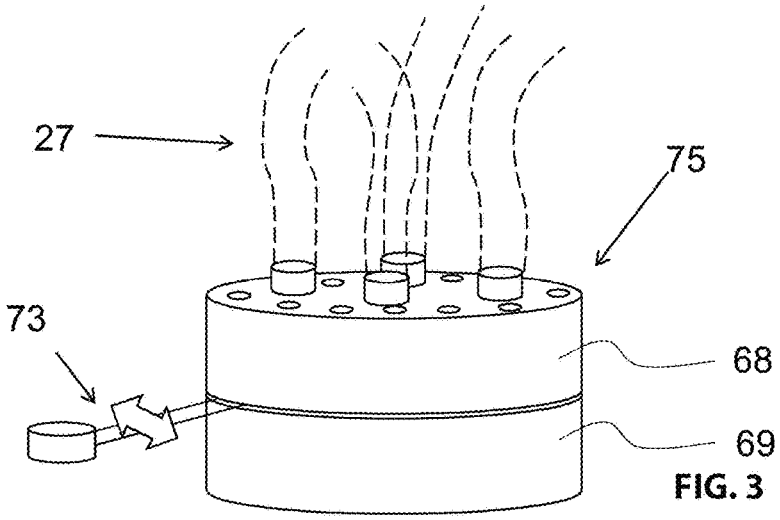
FIG. 3 shows a sliding or template valve for opening and closing the connecting hoses between the compartments/air chambers in a metered fashion.

FIG. 3 shows a sliding or template valve 75 with an upper disk 68 and a lower disk 69. A thin, not-shown perforated disk in the form of a hole template is rotatably inserted between these two discs 68, 69. The connecting hoses 27 lead into the top of the upper disk 68 from above. The axial bores in the upper disk 68 lead into axial blind bores in the lower disk 69, in which they turn by 180° and once again lead upward into a second hose through the upper disk 68. The holes in the hole template make it possible to close the bores in a metered fashion or to completely close or completely open said bores depending on the rotational position of the hole template adjusted by means of the turning lever 90. In this way, the air exchange between the respective compartments 18 or different air chambers in the wobble cushion can be controlled and even blocked. Such sliding or template valves 75 make it possible to collectively or individually open or close all connecting hoses 27 in a precisely metered fashion. The turning lever 75 may simply be actuated with the cables of a push-pull cable system that lead to a lever arranged on the armrest, wherein the lever may also be positioned elsewhere, preferably above the seat surface, but optionally also underneath the seat surface, and actuated directly or via a rod assembly or hydraulically, pneumatically or electrically.

Figure 4:
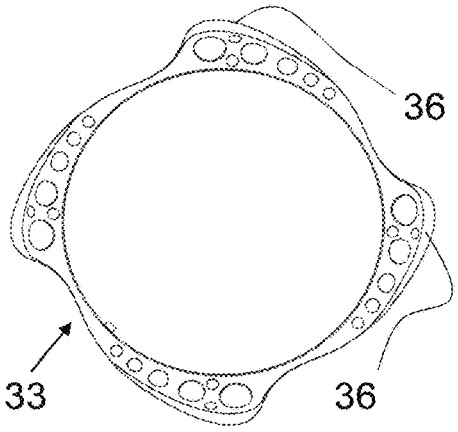
FIG. 4 shows a rotatable pinch ring for forming four pinch valves for the four connecting hoses on the wobble cushion.

FIG. 4 shows a pinch ring 33 of a pinch valve as an alternative to the arguably simplest solution with a sliding or template valve 75. The pinch ring 33 is inserted into an associated guide ring 32 (FIG. 6) that comprises an annular guide channel 34, in which the pinch ring 33 is rotatably supported in order to respectively form four circumferentially distributed pinch valves for the four connecting hoses 27 on the hose ring 16 or between the compartments 18 or between individual cushions (FIG. 10) that are distributed over the circumference of the hollow body 14 and rest on its conical upper side 15. On its periphery, the pinch ring 33 comprises pinching surfaces 36 that have an increasing radius in the circumferential direction and therefore act like ramps during the rotation of the pinch ring such that a hose section 27, which stationarily protrudes into the outer recess of the pinch ring 33, is pinched due to the motion of the ramp formed by the pinching surface 36 against said hose section.

Figure 5:
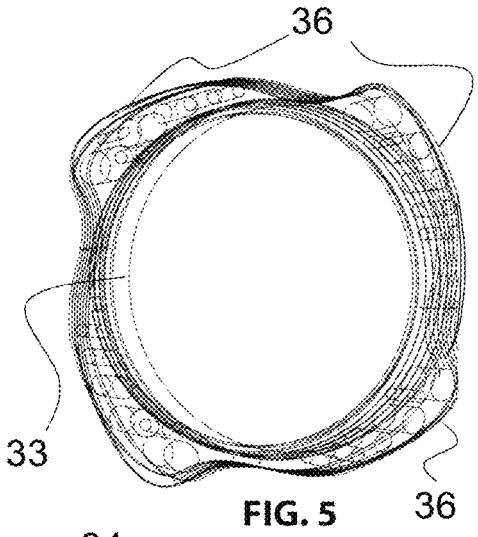
FIG. 5 shows the rotatable pinch ring according to FIG. 4 in the form of a transparent view.
Figure 6:
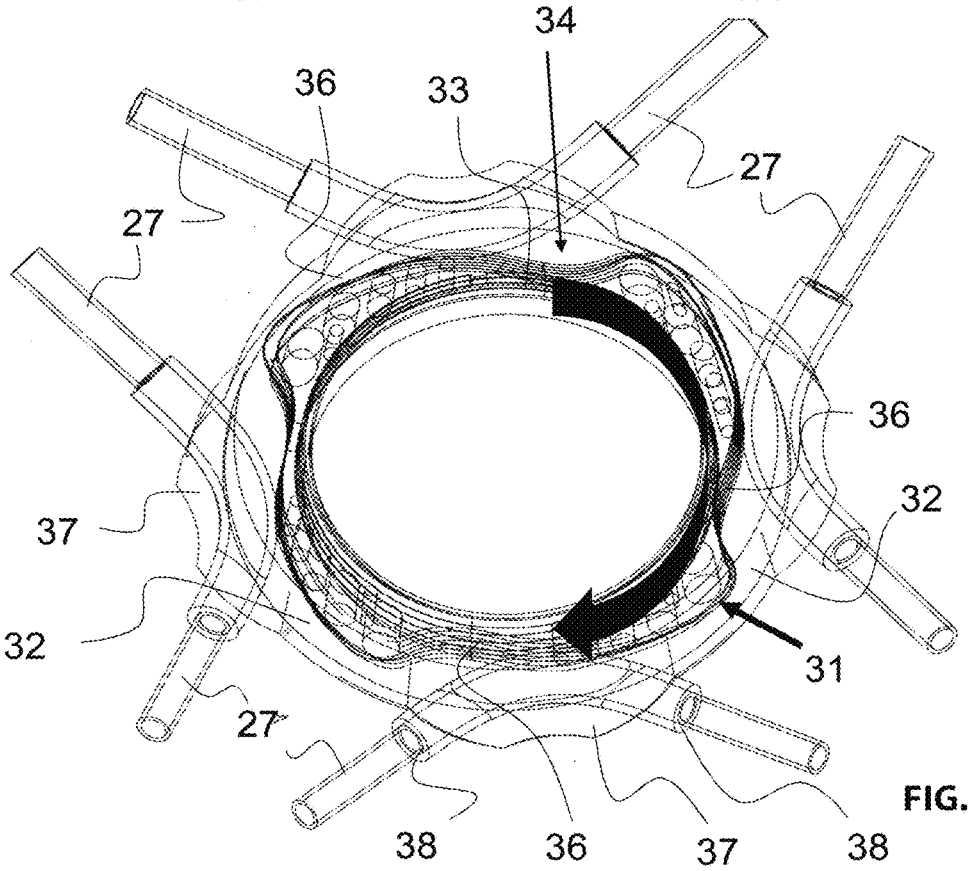
FIG. 6 shows the rotatable pinch ring inserted into the guide ring with its guide channel, in which it is rotatably supported, as well as the hose sections protruding into the guide channel.

This pinch ring 33 is illustrated in the form of a transparent plastic part in FIG. 5, which is located on the right side of FIG. 4, wherein said pinch ring is ultimately illustrated in the state, in which it is inserted into the guide ring 32 with its guide channel 34, in FIG. 6. The pinch ring 33 is inserted into this guide or ring channel 34 rotatably about the common center. As mentioned above, the pinch ring 33 forms on its peripheral outer side four clamping or pinching surfaces 36 with a respectively increasing radius in a circumferential direction. The distance of the pinching surface 36 from the outer wall of the ring channel 34 depends on the rotational position of the pinch ring 33 in the interior of the guide ring 32. Leadthroughs 37 of elastic material are integrally formed on the outer side of the guide ring 32 and respectively comprise two holes 38 extending obliquely to the tangent. A hose section 27 can be respectively routed through these holes 38 as illustrated in the figure such that it protrudes into the ring channel 34 and toward the center of the guide ring 32 in an arc-shaped fashion as shown. When the pinch ring 33 does not contact these arc-shaped hose sections with its pinching surfaces 36, their cross sections are continuously open and not constricted. However, when the pinch ring 33 is rotated in the clockwise direction as indicated with the black arrow in FIG. 6, the pinching surfaces 36 gradually slide on the arc-shaped hose sections and constrict the hose cross sections by pinching the hoses 27. The flow is thereby reduced and totally blocked when the hoses are completely clamped shut. In this case, the elastic leadthroughs 37 protect the material of the hose sections 27 during the pinching process. For this purpose, the leadthroughs 37 are coated, e.g., with Teflon. The rotation of the pinch ring 33 is preferably realized with the cables of a push-pull cable system, the two wire cable ends of which engage on the periphery of the pinch ring 33 and therefore can rotate the pinch ring in one or the other direction as needed, as well as lock the pinch ring in any rotational position. The lever or an adjusting wheel or turning handle for actuating the push-pull cable system is preferably arranged on the armrest, but may also be positioned elsewhere. In this case, the pinch ring 33 is rotatable to a sufficient degree such that it collectively seals the hose sections 27 with its pinching surfaces 36 in the end position. If applicable, conventional Bowden cables may also be used for the adjustment instead of push-pull cable systems, wherein the rotatable pinch ring 33 is spring-loaded by means of a coil spring in this case such that the Bowden cable pulls against this spring force, which can rotate the pinch ring back into its starting position. The pulling action can be transmitted via an inverted pulley block such that a sufficient rotation of the pinch ring 33 of about 30° can be achieved with a short lever stroke. It is also conceivable to implement a hydraulic, pneumatic or electric actuation. The complete pinch ring valve is inserted into a circular recess in the conical upper side 15 of the hollow body 14 such that the pinch ring valve comes to rest at the height of the arc-shaped hose sections 27 of the attached hose ring 16 in the assembled state.

Figure 7:
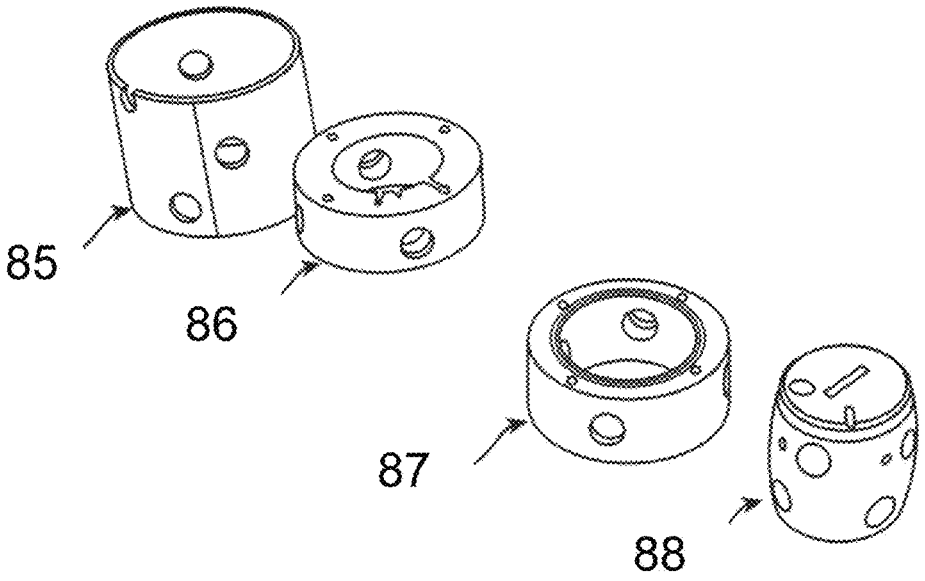
FIG. 7 shows the components of a turning valve as an alternative to a pinch valve for the connecting hoses of the compartments of the hose ring.
Figure 8:
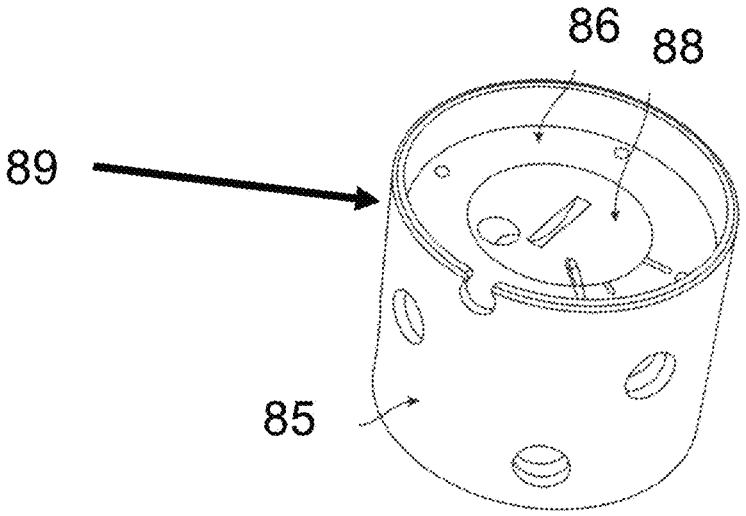
FIG. 8 shows the assembled turning valve for the connecting hoses of the compartments of the hose ring.

FIG. 7 shows the components of a turning valve that may be used as an alternative to such a pinch ring valve. It consists of a casing tube 85 with connections for the connecting hoses 27 of the wobble cushion with its air chambers or of the compartments 18 of the annular tube 16. The components of the turning valve include an upper 86 and a lower fitting tube 87 with bores in their walls, as well as a rotary pin 88 with internal bores. The complete turning valve 89 is illustrated in its assembled state in FIG. 8. The fitting tubes 86, 87 enclosed in the interior of the casing tube 85 and the rotary pin 88 can be turned relative to one another in order to thereby open or seal different passages depending on the rotational position. When the connecting hoses 27 are connected to the holes on the outer side of the casing tube 85, the flow through a certain connecting hose can be released in a metered fashion depending on the rotational position, wherein the entire cross section of the hose can also be released or the flow can be completely blocked. The rotation of the central rotary pin 88 is realized by means of the cables of a push-pull cable system, the actuating lever of which is preferably arranged on the armrest, in that the cable ends act upon a lever attached to the upper end face of the rotary pin 88. This lever may alternatively also be actuated with a Bowden cable against the force of a coil spring in order to rotate the rotary pin 88 by at least one hole diameter in its peripheral wall, as well as to once again rotate the rotary pin back due to the force of the coil spring. A hydraulic, pneumatic or electric actuation may also be realized.

Figure 9:
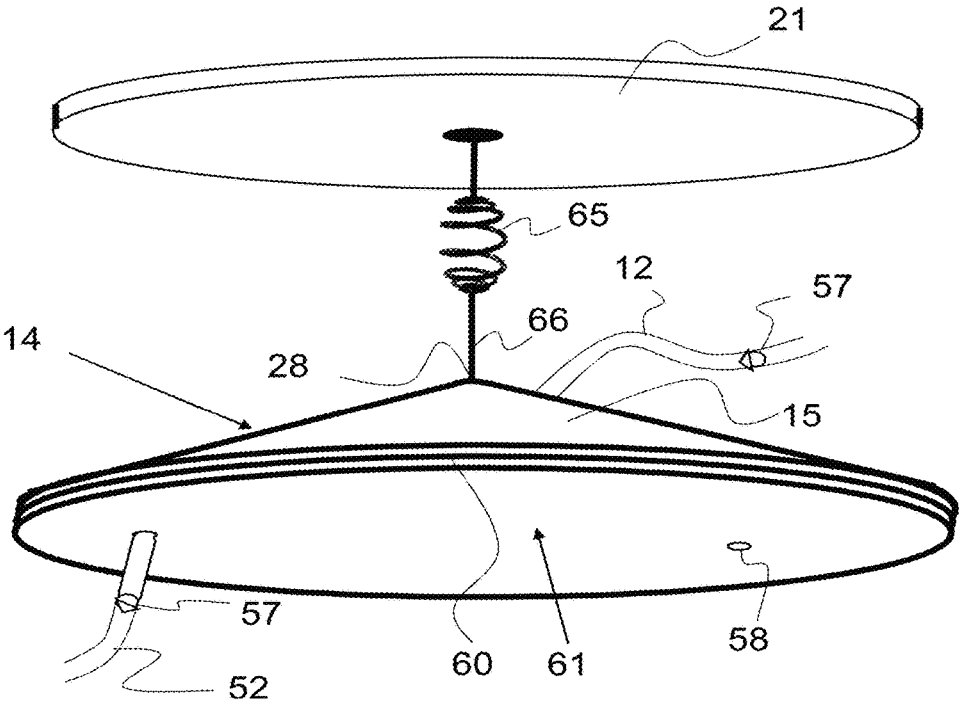
FIG. 9 shows the hollow body in the form of a truncated cone, which serves as support and pump for the wobble cushion or the individual cushions, as well as its supply and discharge valves, in the form of an oblique view from below.

FIG. 9 shows the hollow body 14 in the form of a truncated cone, which serves as support for the hose ring 16 with its pinch valve 31, sliding valve 75 or turning valve 89 to be supported thereon, wherein the hollow body is illustrated in the form of an oblique view from below in this figure. This hollow body 14 additionally acts as a reservoir for compressed air. For example, a hose 52 extending through a bore in the interface plate 5 leads from the region underneath the interface plate into the hollow body 14 via a one-way valve 57. The hollow body 14 is realized in the form of an airtight hollow body consisting, for example, of injection-moulded or moulded plastic. It may be assembled of multiple parts by means of welding. The material used may also consist of sheet metal rather than plastic and be realized, for example, in the form of a sheet metal cone and a steel plate arranged thereunder, wherein the cone is connected to the steel plate in a sealed fashion by means of a peripherally extending elastic rubber bellows 60. The lower bottom plate 61 has to be sufficiently strong for withstanding the internal pressure. If it is curved inward, i.e. if it has a concave shape on the outer side, the entire hollow body 14 is highly resistant to pressure. The wobble cushions with their air chambers or the hose ring 16 respectively are/is placed on the conical upper side 15 and the conical outer wall of the hollow body 14 subsequently serves as the actual supporting surface for the seat panel 21 and the seat pad 19 of the office, work and leisure chair that is subjected to the load of a person. The seat panel 21 resting on the hose ring 16 above the hollow body 14 is in its center connected to the conical upper side of the hollow body 14 by means of a wire cable 66 such that the office, work and leisure chair can also be taken hold of at the seat pad 19 in order to be lifted and carried over steps. In one variation, a progressively acting tension spring 65 may also be incorporated into this wire cable 66 and connected to the point 28 of the conical upper side 15 of the hollow body 14 such that the seat panel 21 is constantly pulled downward against the hose ring 16. This tension can be increased by adjusting a higher or lower tensile stress of the tension spring 65 on the seat panel 21 by means of a screw such that it presses the seat panel 21 against the hose ring 16 or the wobble cushions with more or less intensity and thereby rigidifies the wobble capability.

Figure 10:
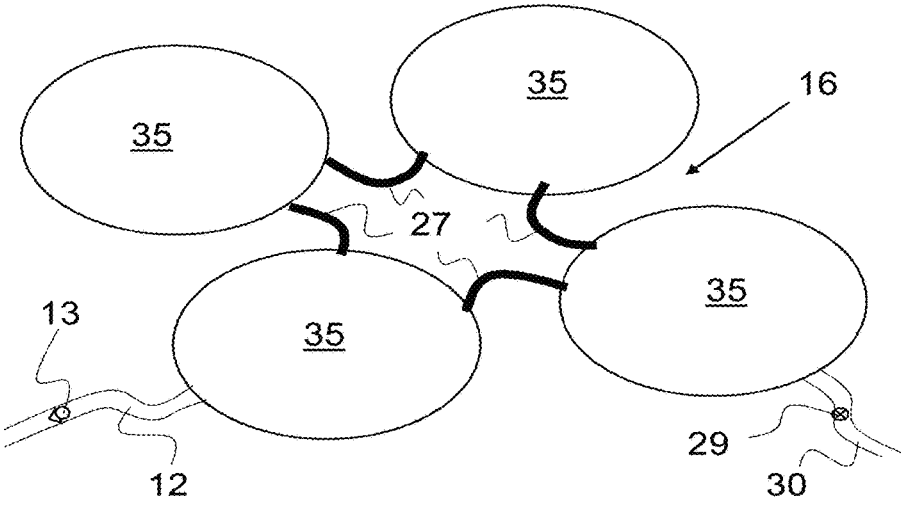
FIG. 10 shows a wobble cushion in the form of four individual cushions that are connected by means of connecting hoses as an alternative to a hose ring.

FIG. 10 shows an alternative embodiment of the respective wobble cushion or hose ring 16. The wobble capability is achieved by means of four different individual cushions 35 that rest on the conical upper side 15 of the hollow body 14, wherein adjacent cushions are respectively connected to one another by means of a hose section 27 that protrudes into the center by a certain distance. These four hose sections 27 can be collectively closed to a greater or lesser extent in the above-described fashion by means of a respective sliding or template valve 75, a turning valve 59 or a pinch valve 31 or even entirely closed by being completely clamped shut such that an air exchange between the individual cushions 35 is no longer possible. As already explained above with reference to the hose ring 16 in FIG. 2, a hose 30 with a controllable discharge valve 29 likewise leads out of at least one of the individual cushions 35, wherein a supply hose 12 with a one-way valve 13 also leads into one individual cushions 35. It is obvious that the thusly formed wobble cushion can also be realized with more or fewer than four individual cushions 35 or even in the form of a single hose ring with more or fewer than four compartments 18 or air chambers. The connecting hoses 27 may also be respectively and therefore individually equipped with a sliding valve 75 or turning valve 59.

Figure 11:
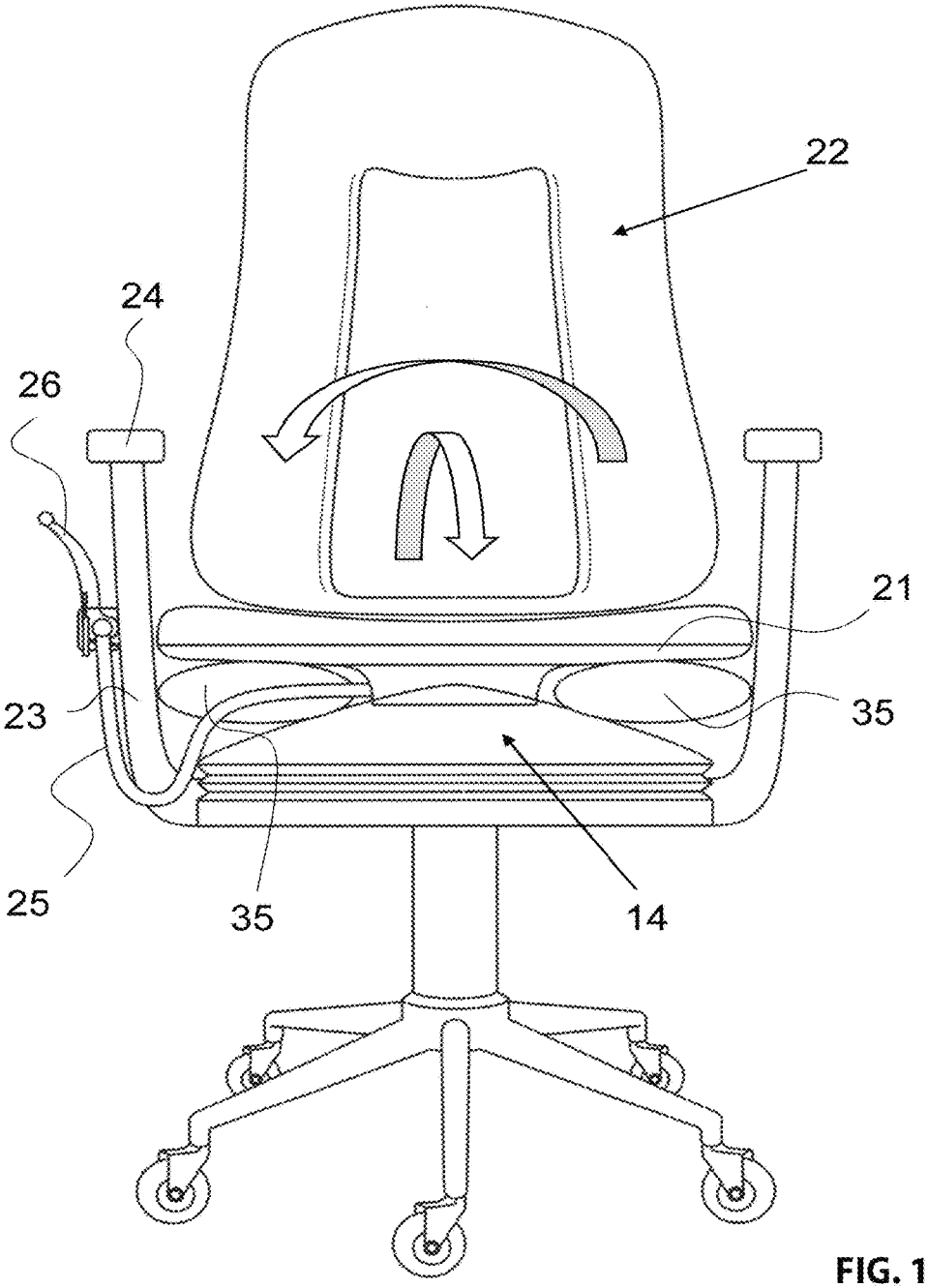
FIG. 11 shows a front view of an office, work and leisure chair with four individual cushions, which is open on the bottom.

FIG. 11 shows an office, work and leisure chair, which is open on the bottom and in which the individual cushions 35 are illustrated analogous to FIG. 10, wherein the front cushion is not shown in order to provide a view of the interior. These individual cushions 35 rest on the hollow body 14. The seat panel 21 rests on top of the individual cushions 35. This chair is equipped with armrests 24 that are arranged on height-adjustable arm supports 23. In this case, a lever 26 for actuating a push-pull cable system or a Bowden cable is arranged on one of the arm supports 23. The cables lead to the central valve that may consist of a sliding valve 75, a turning valve 89 or a pinch valve 31 and serves for opening and closing the connecting hoses between the individual cushions in a metered fashion. If multiple sliding valve 75 or turning valves 59 are provided, the connecting hoses 27 can also be individually opened and closed in a metered fashion.

Figure 12:
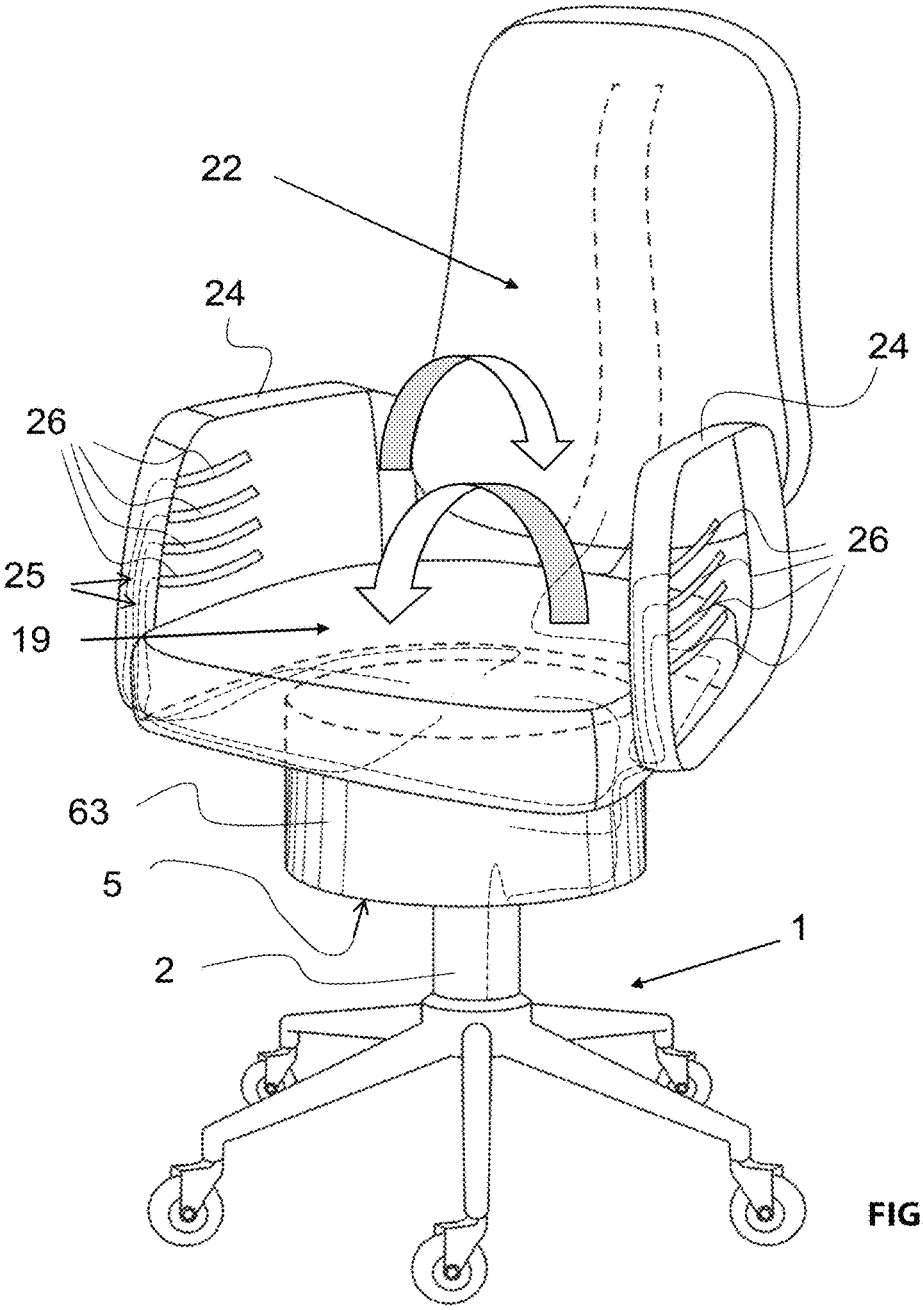
FIG. 12 shows the office, work and leisure chair according to FIG. 1 in the assembled state with additional armrests.

FIG. 12 shows the assembled office, work and leisure chair with wobble-action seat surface 19 in the form of a front view. The cruciform base 11 and the pneumatic spring-action post 2 are illustrated in this figure. The entire substructure for realizing the metered wobble capability is concealed by an apron 63. Height-adjustable armrests 24 are conventionally mounted laterally on the interface plate or on the post 2. One peculiarity can be seen in that multiple handle levers 26 are arranged on the armrests 24. They serve for controlling and adjusting different functions of this specific chair. However, they may also be replaced with adjusting wheels or turning handles. The arrows above the seat surface 19 indicate that this seat surface can respectively carry out wobbling motions in these directions or superimposed wobbling motions in all directions. The wobble capability, the wobbling distance and its damping can be adjusted with the aid of the installed valves. Since persons with very different weights must be able to use the chair, i.e. a lady with a body weight of 45 kg or a gentleman with a considerable body weight of 150 kg or even more, these adjustments are very important for this reason alone. For a heavy person, the maximum pressure in the wobble cushion or the air chambers is adjusted higher and the seat panel 21 is tensioned against the wobble cushion with a greater force than for a lighter person. A corresponding actuation of the different push-pull cables or Bowden cables makes it possible to subject associated cables 25 or cable pairs indicated with broken lines to tension or pressure and to thereby open or close the valves between the compartments 18 of the wobble cushion 16 in a metered fashion, as well as to adjust the height of the post 2 and the inclination of the backrest 22. The backrest 22 is conventionally mounted pivotably on the interface plate 5 or on the post 2 in a spring-loaded fashion. All in all, the following adjustments or controls can be realized with the push-pull cables or Bowden cables 25 or alternatively with hydraulic, pneumatic or electric actuating means:

- metered opening or closing of the pinch valves 31
- metered opening and closing of the sliding or template valve 75 or the turning valve 89
- metered opening and closing of multiple sliding or template valves 84 or turning valves 89 independently of one another
- adjusting the height of the seat surface 19
- opening and closing the discharge valve from the wobble cushion 16, 35
- adjusting the tensile force of the progressive spring between the hollow body 14 and the seat panel 21
- adjusting the inclination of the backrest 22
- adjusting the seat panel 21 with its seat pad 19 forward and backward on the interface plate 5
- adjusting the height of the armrests 24 an armrest supports 23
- adjusting the phoronomic elements of the backrest (as described further below).

Figure 13:
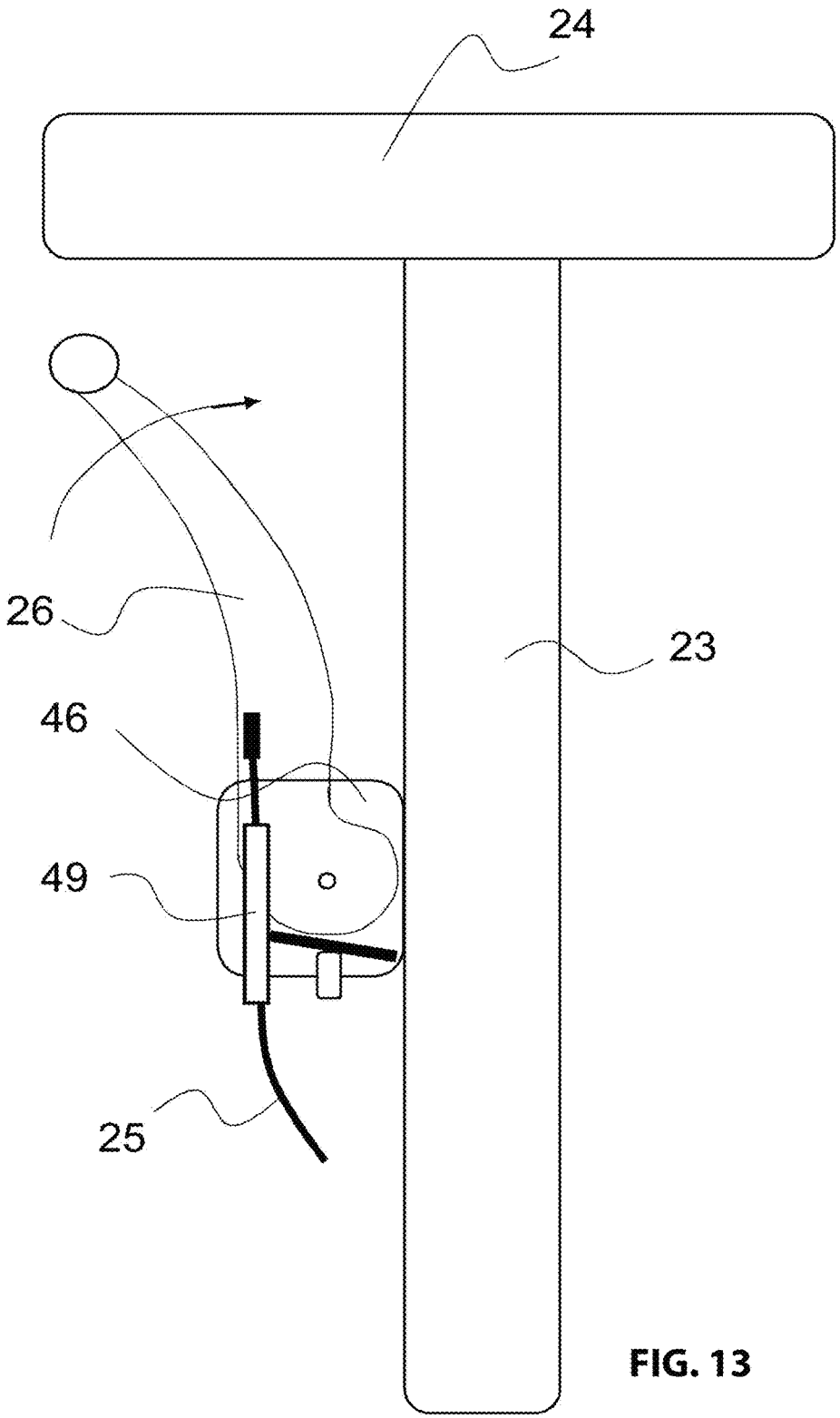
FIG. 13 shows an armrest with the lever for actuating a Bowden cable for the actuation of the pinch valves installed thereon.

FIG. 13 shows an armrest 24 of the office, work and leisure chair with the lever 26 that is installed underneath the armrest and serves for actuating the cables of a push-pull cable system or Bowden cable 25 in order to actuate the valves in the exemplary embodiment. Both armrests 24 are respectively supported on a height-adjustable armrest support 23 that is respectively mounted on the substructure of the chair or on the interface plate 5. In the example shown, handle levers 26 realized similar to bicycle or motorcycle brake levers are installed on the armrest supports 23. Upon its actuation, this handle lever pulls on one cable of the push-pull cable system or on a Bowden cable, wherein said cable rotates, for example, the pinch ring 33 in the guide ring 32 or opens or closes a differently designed valve in a metered fashion as described above when it is subjected to tension. The handle lever 26 is pivotably mounted in a base 46 and this base 46 is connected to the armrest support 23. In order to achieve sufficient adjustment travel with the lever motion, the Bowden cable may form a pulley block in an inverted fashion underneath the seat panel or the motion of the push-pull cable can be geared up in order to realize greater travel.

Figure 14:
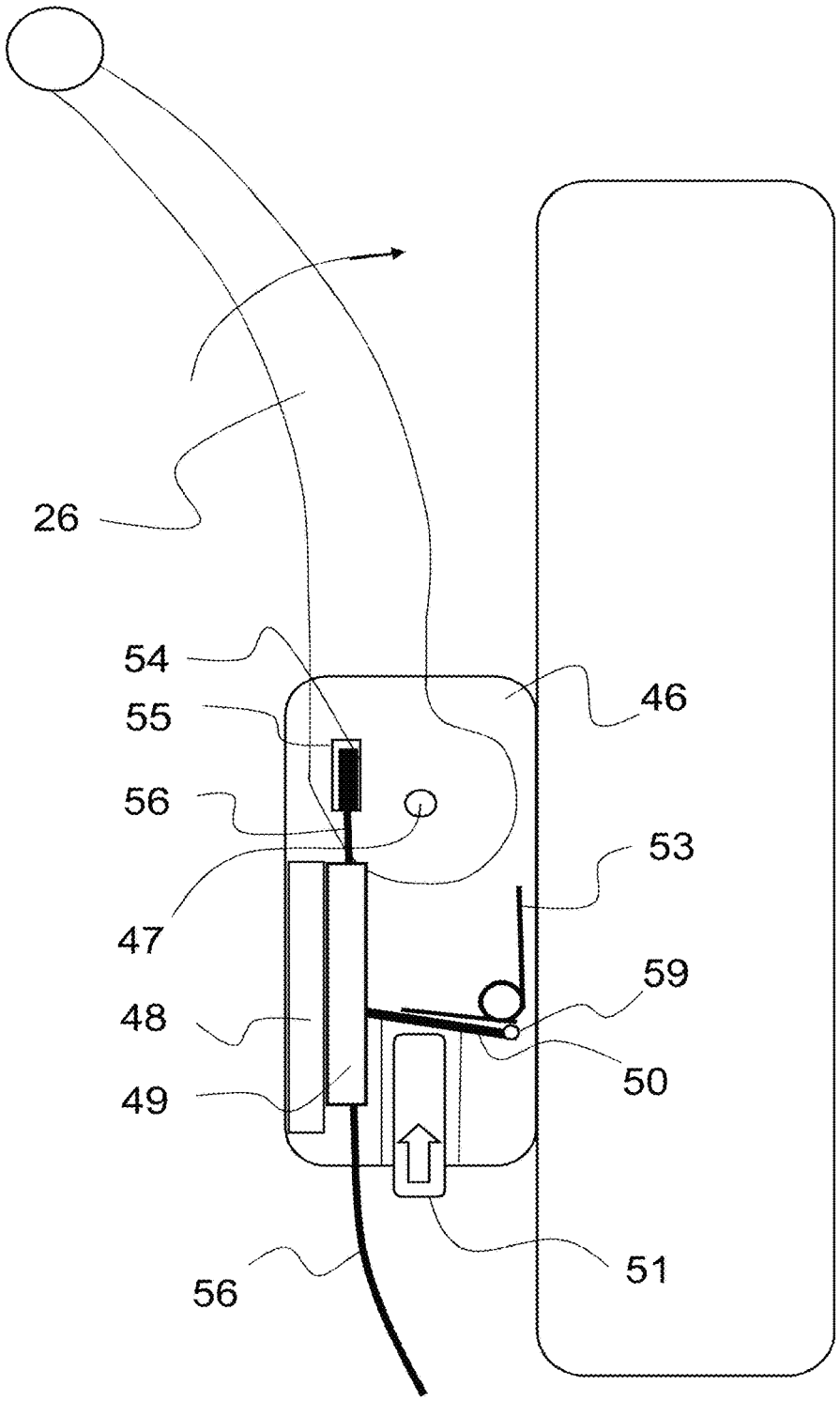
FIG. 14 shows the lever on the armrest, which can be locked in any position of the Bowden cable by means of spring-loaded clamping plates.

FIG. 14 shows a lever 26 that is arranged on an armrest support 23 and comprises a device for locking the Bowden wire cable 25 in any position by means of a spring-loaded clamping plate 50 that is pivotable about a lateral axis 59. In its end region, the wire cable 56 is enclosed by a steel cylinder 49, to which it is rigidly connected. Its end carries a head 54 that is seated in a mounting 55 in the handle lever base 46. The handle lever 26 can be pivoted about the axis 47 against the force of the torsion spring acting upon the pinch ring 31. In order to lock the wire cable 56 in any tensioning position and therefore any rotational position of the pinch ring 31, a pivotable clamping plate 50 acts upon the steel cylinder 49, which is supported on the other side along a supporting surface 48, at a very steep angle of slightly less than 90°. The clamping plate 50 is spring-loaded by means of a steel spring 53 and therefore constantly pivoted against the steel cylinder 49. When the handle lever 26 is actuated and in this case pivoted in the clockwise direction, it pulls the wire cable 56 upward such that the steel cylinder 49 enclosing the wire cable 56 is also pulled upward and drags past the front edge of the clamping plate 50. As soon as the hand lever 26 is released, the torsion spring in the pinch ring 31 attempts to pull the wire cable 56 back down and thereby causes the clamping plate 50 to instantaneously and rigidly clamp the steel cylinder 49 in its position. The wire cable 56 and its steel cylinder 49 can only move downward after the clamping plate 50 has been pivoted upward in the clockwise direction against the force of the spring 53 in order to thereby release the steel cylinder 49. The lock produced by means of the clamping plate 50 can be released by pressing on the pushbutton 51 spring-loaded by the steel spring 53 from below.

The function of the above-described office, work and leisure chair and its components, as well as its effects on the person using the chair, are elucidated in greater detail below. The pressure reservoir in the form of the airtight hollow body 14 initially has to be filled from its starting position. This is achieved in that the person sits down on the office, work and leisure chair, if necessary multiple times, in order to activate the pump function of the substructure. Every time the person sits down on the office, work and leisure chair, air is pumped into the wobble cushion through the hose 12 and the installed one-way valve (FIG. 1). A pressure control valve 58 limits the maximum pressure in the hollow body 14.

The height of the office, work and leisure chair or of its seat surface 19 can be conventionally adjusted by means of the height-variable post 2 that contains a pneumatic pressure spring for this purpose. However, an important difference can be seen in that the actuation is realized by means of a push-pull cable system or a Bowden cable and the associated lever 26 is installed on an armrest above the seat surface 19. This is much more convenient than effectively searching for a lever blindly with the hand. The height of the chair can be reduced with the lever 26 while sitting in that the cable disengages a lock such that the length of the post 2 is reduced against the force of the pneumatic spring. In order to raise the seat surface 19, the load on the seat surface 19 needs to be slightly reduced analogous to conventional height adjustments of office chairs with pneumatic spring-action posts 2.

Once the hollow body 14 is filled with compressed air, air can flow into the wobble cushion or the air chambers or the hose ring 16 through the hose 12 and the valve 13 such that the seat panel 21 with its seat cushion is raised. The seat surface 19 can now wobble in all directions. The air in the hose ring 16 is distributed with all-around equal pressure into the four compartments 18 or into the multiple individual cushions 35 because they are connected by means of the hoses 27. The higher the pressure is chosen in the wobble cushion, the more resistant and limited the wobbling motion take place when the person seated on the chair leans to one side or forward or backward. In any case, the inclination or wobbling motion is progressively absorbed by the wobble cushion. If the wobble cushion is inflated to a firm setting, air can be discharged into the surroundings through the controllable discharge valve 29 and the discharge hose 30. Subsequently, the seat surface 19 is capable of wobbling by a greater angle of inclination. The discharge valve 29 for releasing pressure from the wobble cushion or the hose ring 16 or an individual cushions 35 can be actuated by means of a screw-type valve, a push-pull cable system or a spring-loaded Bowden cable.

An actuation of the hand lever 26 causes the valves to be actuated and the connecting hoses 27 between the compartments 18 or individual cushions 35 to be pinched together to a greater or lesser extent such that only a limited air exchange takes place. The wobbling motion of the seat surface 19 from one inclined position into another inclined position therefore can only take place slowly because the air flow through the connecting hoses 27 is throttled. For example, if the seat surface 19 is inclined completely toward the left and the seated person exerts pressure upon the right buttocks region, the seat surface 19 is only inclined slowly toward the right, i.e. the smaller the flow cross sections due to metering of the flow, the more time a wobbling motion requires from the extreme left to the extreme right. Consequently, the wobbling motion can be dampened to a greater or lesser degree at will. The wobbling motion may last a few minutes whereas the motion over the same angle is possible instantaneously when the hose connections 27 are completely open. The larger the flow cross section is adjusted, the more unsteady the wobbling motion will be. A person is seated on a very wobbly seat surface 19 when the hose connections 27 are completely open. The seated person constantly has to unconsciously balance the seat surface 19 in accordance with the degree, to which the hose connection 27 are opened, such that the pelvic muscles are subliminally active at all times. When the connecting hoses 27 are completely closed, a wobbling motion is in contrast essentially limited to the elasticity of the wobble cushion, wherein the seat surface 19 is nearly stable when the wobble cushion is inflated to a firm setting. If a separate sliding valve 75 or turning valve 89 is installed for each hose connection 27, the flow through these hose connections 27 can be individually metered and the hose ring 16 or the individual cushions 35 can also be placed on the conical upper side 15 of the hollow body 14 differently, e.g. such that the partition surfaces 17 are aligned forward and laterally or in the other instance turned from this position by 45°. All intermediate positions of the partition walls or individual cushions 35 between the described positions may be considered. The characteristic of the wobble capability of the seat surface 19 varies in dependence on the positioning of the hose ring 16 or the individual cushions 35.

All in all, this office, work and leisure chair causes subliminal dampened pelvic motions of the person sitting thereon—without a force being actively exerted by the office, work and leisure chair itself. These pelvic motions are realized by means of the adaptive load-dependent kinematics of the wobble-action seat surface 19 presented herein. Since a seated person essentially never sits on a completely stationary seat surface, this person constantly carries out an unnoticeable subliminal pelvic motion. Coupled motions (motions) are therefore induced. This activity of the musculature has lasting positive effects on the entire body, as well as the mental performance of the seated person.

In another embodiment, the internal pressures of the individual compartments 18 or individual cushions 35, which vary due to the wobbling motions of a seated person and the thusly generated air exchanges, are measured by means of pressure sensors in the compartments 18 or individual cushions 35 and stored in a computer unit. Alternatively, the wobbling motion can be measured as a function of the time by means of corresponding smartphone software. For this purpose, the seat panel 21 is equipped with a slot-shaped garage, into which a smartphone can be inserted such that it participates in all wobbling motions and registers their respective extent and direction. The data can be subsequently read out, stored in a computer unit and further evaluated. This data represents an individual user profile.

In a variation, in which the chair is equipped with a battery, the corresponding valves can be opened and closed electrically, for example by means of electric solenoid valves that form the intake valve 13 and the discharge valve 29, as well as additional solenoid valves that act as pinch valves, or solenoid valves that are directly installed into the hoses 27. In addition, an SPS control may be provided in order to actively execute a user-specific wobble program. In this particularly ingenious embodiment of the office, work and leisure chair, a pressure sensor is therefore once again installed in each compartment 18 or the hose ring 16 or in each individual cushion 35 of the wobble cushion and continuously delivers pressure values to a computer via an interface such that the computer can subsequently process this data into a user profile. Accordingly, the pneumatic connecting hoses 27 between the individual compartments 18 or individual cushions 35, as well as the supply valve 13 and the discharge valve 29, can also be opened and closed electrically or in a motor-driven fashion such that a specific, selectively auto-generated and stored user profile or a user profile produced by means of a random generator or a manually entered profile can be executed as a function of the time via SPS by correspondingly opening and closing the valves to a greater or lesser extent as a function of the time. The latter constantly and unavoidably induces the person using the chair to carry out more or less significant wobbling motions on the seat surface 19. An electric variation can ultimately also be equipped with sensors that determine when the hose ring 16 or the individual cushions 35 or the wobble cushion has/have been completely lowered on the inserts 67 due to an air loss such that an acoustical and/or optical signal can be delivered every time this potentially occurs and the wobble capability of the seat surface would be lost or a mechanical impulse can be delivered to the seated person in order to prompt this person to stand up and inflate the wobble cushion by sitting down once or multiple times.

Figure 15:
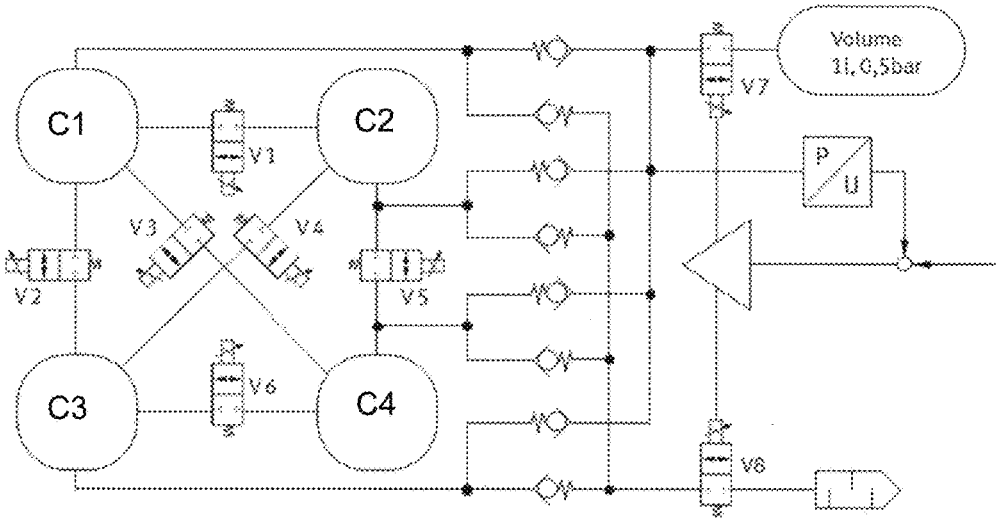
FIG. 15 shows a circuit for detecting and interactively controlling the wobbling motions by means of piezoelectric valves or solenoid valves in an electric variation of the office, work and leisure chair.

An electric variation of this office, work and leisure chair also provides many additional options, namely an interactive agility of the therefore dynamic sitting that can be realized, e.g., with a circuit of the type illustrated in FIG. 15. In this case, the wobble characteristic is varied as a function of the time in that the air pressure in the wobble cushion as a whole can be changed and the air exchange between adjacent compartments or air chambers is actively controlled by an associated electronic control, wherein solenoid valves, piezoelectric valves or position-controlled proportional valves V1-V8, which can be electrically actuated in a precisely controlled fashion, are installed instead of mechanically actuated valves. These valves can allow an air exchange between the four air cushions C1 to C1 in the example shown to a greater or lesser extent in a precisely metered fashion or interrupt such an air flow and react quickly. This quick reaction is realized by utilizing a pressure reservoir with a volume, e.g., of 1 liter and a pressure of 0.5 bar. The control of these valves V1-V8 is based on an electronic circuit including high-resolution sensors for measuring the acceleration, the speed, the time and therefore the distance and the inclination of each wobbling motion. Processing of these values ultimately makes it possible to offer the user a broad spectrum of motion patterns that can be correspondingly selected on the chair in accordance with the user's current muscular/joint-mechanical/sensorimotor constitution. In this case, the "at a whim principle" is less important than the "correct degree" of challenge in order to maximize a training effect beyond a potential frustrating overload due to excessively pronounced constant wobbling. The chair thereby becomes an intelligent sitting coach. The different degrees of freedom of the wobbling motion can be measured and visually displayed. The measured deviations—a delta—can be adapted and managed with a smartphone-based application. This is intended to provide the user of the chair with a stimulating tool for optimizing the user's training and learning path while sitting. The application on the smartphone can detect and display the individual motion typology of the seated person. The application links the measured values with categorized statements on the extent, to which the user is able to respectively dampen or stabilize the degrees of freedom offered by the wobble cushion in terms of sensorimotor and muscular aspects. This provides an indicator for the current individual sitting agility and therefore information on how the wobble cushion should be adjusted in order to maximize the product of comfort and training progress. In this context, it is naturally important to ensure the respective data protection and the personal rights of the users. It is particularly important to ensure that neither the personnel department nor the company physician has unauthorized access to the data. In case this data is intended for use in scientific evaluations, it can only be used anonymously.

The purchase of the chair authorizes the user to download an application to the smartphone. Subsequently, this smartphone is inserted into the "garage" underneath the cushion of the chair. A voice then guides the user through a test, in which the user adjusts control buttons for the values of the user's individual maximum wobbling motion about the x-axis and y-axis. For this test, the user should balance as stable as possible for approximately 10 to 20 seconds without contacting the backrest and with the legs crossed and not touching the ground. Such a cycle can be repeated multiple times in order to derive a typical individual balancing pattern thereof. The voice from the smartphone bids farewell with the words that this is now the optimal adjustment for the time being, as well as for the next x months, and that the voice will check in with the user again after x months for a new setting. The smartphone can then be removed from its receptacle. The following parameters are determined with this evaluation of the individual sitting habits of a user:

- deviation from the starting point, with amplitude and frequency
- hold time at each point
- swept integral, total and sectorally
- correction or adjustment angle (error "optimal correction")
- overshooting of the correction or adjustment.

Another information segment can cover the following: intermediate stimulation for exercises, variation of the sitting position, ergonomics, change of the table height and monitor position, relaxation, at-home training, etc.

Figure 16:
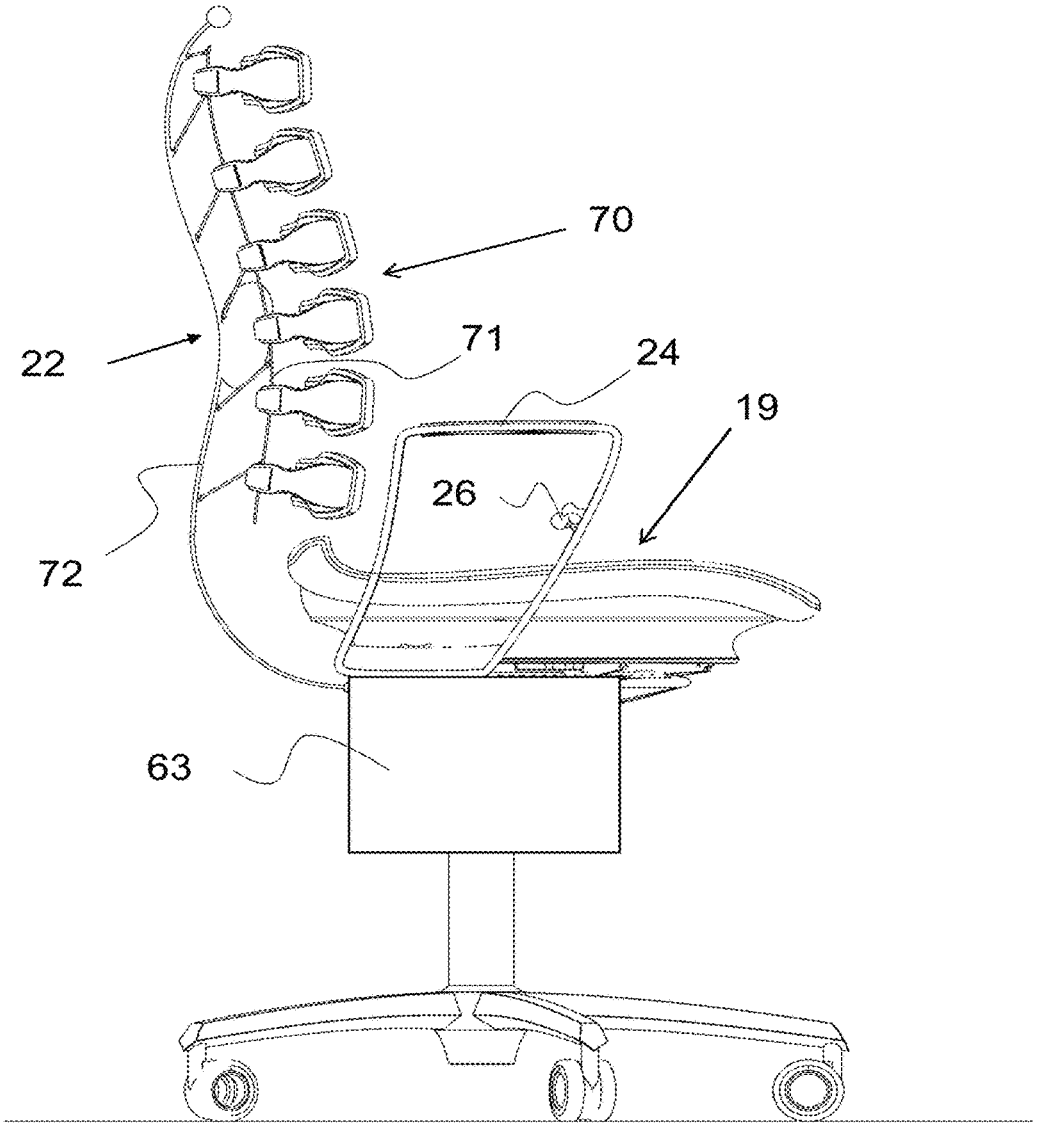
FIG. 16 shows such an office, work and leisure chair with wobble-action seat surface in combination with a backrest of phoronomic elements.

Such an office, work and leisure chair with wobble-action seat surface may furthermore be equipped with a very special backrest, as illustrated in the form of a side view in FIG. 16, in order to stimulate subliminal movements of the back muscles. Another peculiarity of this office, work and leisure chair can therefore be seen in its backrest 22 and its construction of phoronomic elements in order to induce subliminal movements of the back muscles. For this purpose, a backrest 22 in the form of two column bands 71, 72 extends vertically upward behind the seat surface 19 on such a phoronomic backrest 70 along the spinal column of a person seated on the seat surface 19 of the chair. Each of these bands consists of a plane, elastically deformable band that is made, for example, of plastic, wood or a metal sheet. The rear column band 72 is mounted underneath the interface plate and from here initially extends rearward and then upward with a lateral contour that is modeled on the contour of the buttocks and the back of a seated person. However, the inclination of this column band 72 can be adjusted at its mounting point underneath the seat surface. The office, work and leisure chair illustrated in FIG. 16 has a peculiar feature in the form of a base plate behind its apron 63, wherein the bottom plate of the hollow body and all elements for realizing the wobble capability of the seat surface 19 rest on said base plate. The base plate in turn is supported on the interface plate, which is mounted on top of the post 22, such that it can be displaced forward and backward relative to the office, work and leisure chair. This is achieved, for example, by using slide rails or roller tracks. The displaceability can be released by means of a push-pull cable system or a spring-loaded Bowden cable, wherein the associated actuating lever 26 is arranged on an armrest 24 above the seat surface 19.

Figure 17:
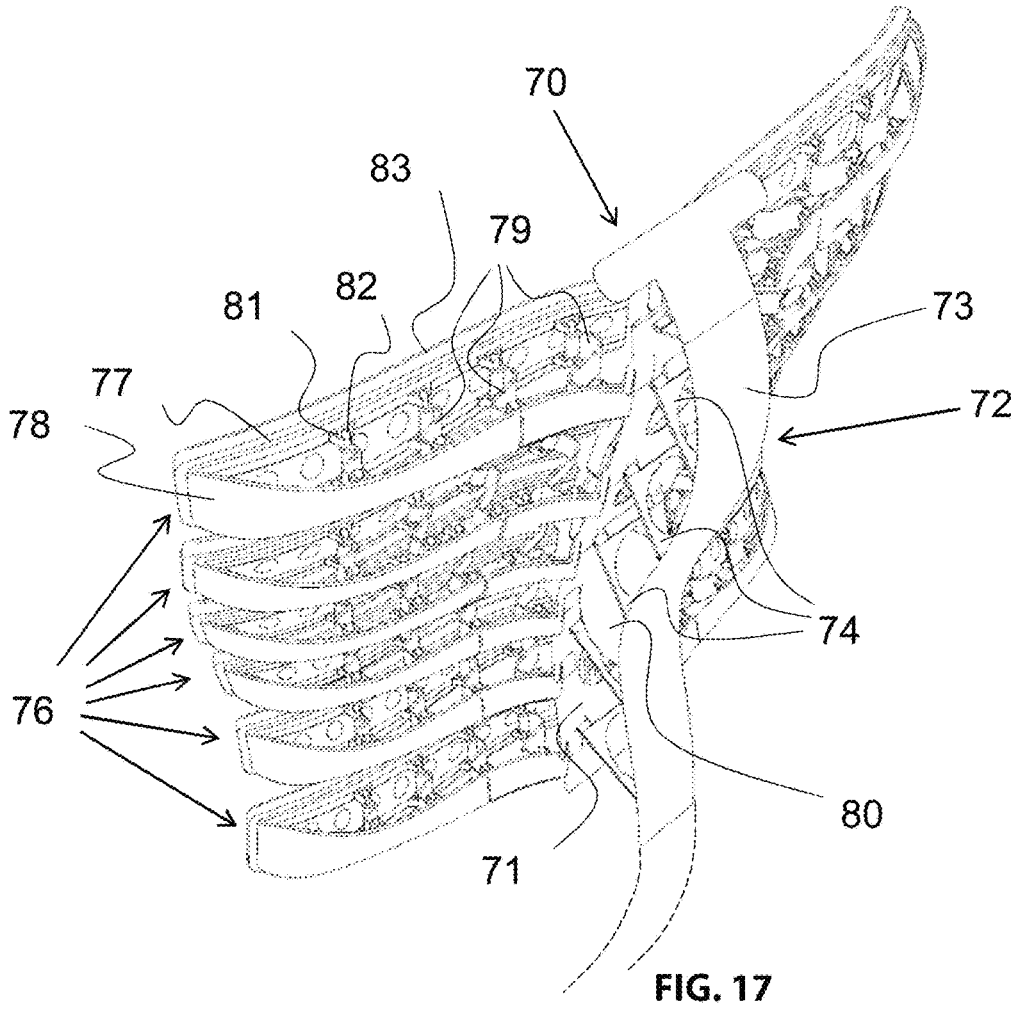
FIG. 17 shows a rear view of the backrest and its phoronomic elements.

The special construction of this phoronomic backrest 70 can be gathered from FIG. 17, in which a specific variation is illustrated in greater detail. In this perspective representation, the backrest is illustrated in the form of an oblique view of its rear side from above. This figure shows the central phoronomic element 70 consisting of the front column band 71 and the rear column band 72, which continues downward as indicated with broken lines. These two column bands 71 and 72 are connected to one another with connecting webs 74. In this case, the connecting webs 74 are formed by flat, rigid elements and respectively provided with a central hole in order to save weight. These connecting webs 74 are on both ends connected to the inner sides of the front column band 71 and the rear column band 72 in an articulated fashion. An air cushion 80 may be installed between the column bands 71, 72 in order to dampen and/or adjust the relative motions between the two column bands 71, 72. In this case, an air cushion 80 acting as a progressive pressure spring is installed between two braces 74. In this way, the backrest is once again returned into its initial state when the load acting thereupon is alleviated. An air hose may lead from the air cushion 80 to a connecting point that is equipped with a valve such that the air cushion can be pumped up to an individually selectable pressure by means of a pump and air can be discharged via the valve in order to individually shape the column bands 71, 72. It is naturally also possible to install multiple separate air cushions of this type between the connecting webs 74. The contour of the front column band 71 can be adapted to a certain back contour of a user by varying the length of the connecting webs 74, their arrangement and their number, as well as the filling pressure of the individual air cushions 80. At least one or multiple steel pressure springs may be alternatively installed between the front column band 71 and the rear column band 72. It is therefore quite obvious that pressure exerted upon the front column band 71 from the front reduces the distance from the rear column band 72, and that the front column band 71 slightly moves upward due to the geometric arrangement of the connecting webs 74, i.e. the front column band is displaced upward relative to the rear column band 72 rigidly mounted on the chair. Phoronomic elements 76 are installed on and laterally branch off the front column band 71 like ribs. These elements form the actual supporting surface of the backrest. When the front column band 71 moves up and down relative to the rear column band 72, the laterally protruding ribs also participate in this up and down motion such that the entire support surface for the back of the person seated on the chair is slightly moved up and down and, in particular, slightly yields upward every time the person leans against the backrest anew. The extent of this upward motion depends on the contact pressure and the dimensions and geometric arrangement of the connecting webs 74 between the front column band 71 and the rear column band 72. However, the ribs are respectively also realized in the form of phoronomic element 76. Each rib is formed by a front cross band 77 and a rear cross band 78. These two cross bands 77, 78 are connected by means of multiple connecting webs 79. In the example shown, these connecting webs consist of elastically bendable connecting webs 79 that respectively form an S and are on both ends mounted on the inner sides of the cross bands 77, 78 in an articulated fashion. This is presently realized in such a way that these connecting webs 79 have on their ends laterally protruding bolts 81 that can be snap-fitted into associated bolt receptacles 82. These receptacles 82 form two approximately semicircular bolt receptacles that can be elastically spread apart from one another such that the bolts 81 of the connecting webs 79 can be snap-fitted into these receptacles 82 and subsequently pivoted back and forth in the receptacles 82. In this way, the connecting webs 79 can be easily replaced with other connecting webs. The removal and installation can be carried out quickly and without tools.

The articulated connections of the connecting webs 74, 79 may be realized displaceably relative to the column band 71, 72 or cross band 77, 78 in the band direction on at least one or on both mounting points of the webs. For example, the bolt receptacles 82 may be guided on the inner side of the cross bands 77, 78 in a longitudinally displaceable fashion. This displacement may be adjustable by means of push-pull cable systems or Bowden cables, wherein the respective wire cables are routed into the end region of the cross bands 77, 78 around one or more deflection rollers and, if necessary, subjected to tensile stress by means of a tension spring. When the Bowden cable is pulled, the bolt receptacles 82 are pulled along toward the center of the backrest. The Bowden cables or push-pull cables are routed to an adjusting wheel, which is arranged on an armrest such that it can be easily accessed in the seated position, via deflection rollers in the interior of the backrest construction, wherein said adjusting wheel can be adjusted into different rotational position and locked in any position.

The front cross bands 77 are provided with holes in this case in order to save weight and their front sides are fitted with soft-elastic cushions 83. When pressure is exerted upon the front cross bands 77 from the front, the S-shaped connecting webs 79 are subjected to a slight elastic deformation and a slight displacement of the front cross bands 77 relative to the rear cross bands 78 also takes place due to the geometry and arrangement of the connecting webs, wherein the rear cross bands 78 either stretch slightly farther or are additionally curved for this purpose depending on the effective direction of the resulting force and the ends of the front cross bands 77 curve forward or rearward. All in all, the front cross bands 77 adapt to the contour of the back of the chair user leaning against the backrest. Due to the outwardly or inwardly directed relative motion of the front cross bands 77 induced by the contact pressure, the back muscles are also massaged in this direction, although only in a completely subliminal fashion. Every time the chair user leans against this backrest anew, it is slightly displaced upward and the laterally protruding cross bands 77 are accordingly slightly displaced outward or inward. All in all, a low-threshold or even subliminal and hardly perceivable, but still very effective massage of the back muscles is achieved and positively affects the remaining body parts.

Figure 18:
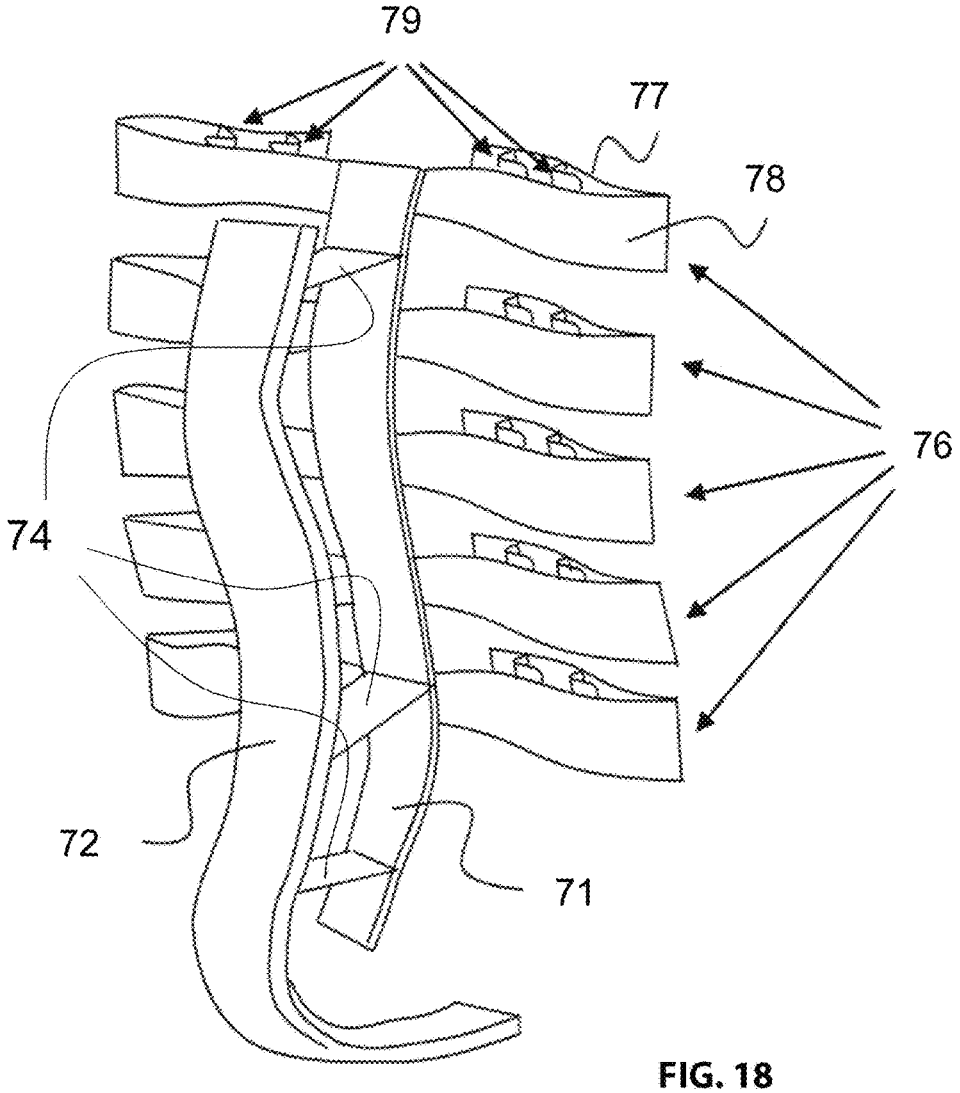
FIG. 18 shows a simple and highly effective construction of the backrest with phoronomic elements.

FIG. 18 shows a particularly advantageous and constructively simple embodiment of this backrest. The rear column band 72 is realized stronger and more rigidly and connected to the front column band 71, which is realized weaker and more flexible, by means of at least three braces 74 installed in an articulated fashion. The phoronomic elements 76, which respectively consist of a front cross band 77 and a rear cross band 78, are installed on and branch off this front column band 71. Multiple S-shaped connecting webs 79 are installed between said cross bands. This backrest construction proves highly dynamic and exceptionally comfortable for the chair user leaning against the backrest. When the chair user leans against the backrest, all elements harmoniously cooperate in order to adapt to the back muscles and simultaneously cause subliminal movements, wherein the region directly behind the spinal column of the user remains clear.

A chair with a wobble-action seat surface of the above-described type can also be realized by means of a retrofit kit that can be attached to any chair. This retrofit kit for being installed on any non-wobbling seat surface comprises all above-described components for realizing the wobble capability of the seat pad. In contrast to an entire office, work and leisure chair, the structure for realizing the wobble capability of the seat pad is realized in the form of a unit and the bottom plate 61 of the hollow body 14 is mounted on a base plate that comprises a peripheral, downwardly protruding apron-like frame on its bottom, wherein the interior of this frame is filled with a foam mass that can be cured under the influence of heat in order to realize a form-fitting adaptation to the contour of the seat surface of a conventional chair to be retrofitted. This unit can therefore be slipped over the seat surface of an office, work and leisure chair, but also on a simple chair such as, e.g., a tabouret. On the other hand, the retrofit kit can also be placed and used on any available seat surface, namely also outdoors. From now on, a wobble-action seat surface for active and healthier sitting is available.

The invention claimed is:

1. An office, work and leisure chair for causing subliminal motions of a person sitting thereon, comprising a cruciform base with freely articulated rollers, at least one pneumatic spring-action post with an interface plate and a seat panel and seat pad resting thereon, and a backrest, wherein the seat panel is mounted with wobble capability on a pneumatic wobble cushion, which comprises multiple deformable air chambers that are connected to one another by connecting hoses and lies on an elastically deformable hollow body, wherein said hollow body operates as a pump for pumping up the air chambers every time a person sits down on the chair and once again fills with air due to elastic expansion of the hollow body every time a person stands up from the chair, wherein a pump hose with a one-way valve leads from the hollow body into at least one of the air chambers in order to compensate for any leakage losses, and wherein the connecting hoses between the air chambers are equipped with valves configured to be opened and closed in a mechanically, hydraulically, pneumatically or electrically metered fashion such that a wobbling distance of the seat panel, as well as a damping of the wobbling motion, is variable.

2. The office, work and leisure chair according to claim 1, wherein the seat panel is supported with wobble capability wherein the seat panel rest on the multiple deformable air chambers of a wobble cushion, which are connected to one another by the connecting hoses and realized in the form of compartments of a hose ring that are formed by partition walls or by multiple individual cushions, which rest on an upwardly protruding conical upper part of the hollow body circularly about a center of the seat panel, wherein the valves connecting the hoses between the air chambers are configured to be opened and closed in a metered fashion by a push-pull cable system or a Bowden cable such that the wobbling distance of the seat panel, as well as the damping of the wobbling motion, is variable.

3. The office, work and leisure chair according to claim 1, wherein the connecting hoses are connected to one or more sliding or template valves or to one or more turning valves with parts that are rotatable relative to one another such that passages in the valves can be moved into different rotational positions in a metered fashion by being turned with the aid of a push-pull cable system or Bowden cables in order to thereby open or close said passages in a metered fashion.

4. The office, work and leisure chair according to claim 1, wherein the respective air chambers or compartments are formed by multiple partition walls in an interior of a toroidal hose ring, wherein adjacent compartments are connected by the connecting hoses that protrude toward a center of the toroidal hose ring in an arc-shaped fashion or, in the case of air chambers or wobble cushions in the form of individual cushions, adjacent individual cushions are connected by the connecting hoses that protrude toward the center of the toroidal hose ring in an arc-shaped fashion, and the valves connecting the hoses between the air chambers comprise pinch valves arranges in the center of the toroidal hose ring for each arc of a respective one of the connecting hoses, through which these arc-shaped hose sections extend, wherein these pinch valves comprise a guide ring that forms an upwardly open channel and a pinch ring that is rotatable therein about a center of the guide ring and comprises outer pinching surfaces that have a decreasing radius from the center of the guide ring in a rotating direction such that the hose sections protruding into the open channel of the guide ring can be pinched between an inner side of an outer wall of the open channel of the guide ring and the pinching surfaces in a metered fashion by rotating the pinch ring against a spring force with the aid of a push-pull cable system or a Bowden cable in order to thereby open and close the hose sections in a metered fashion.

5. The office, work and leisure chair according to claim 1, wherein foam bodies are accommodated in the air chambers and act as spacers in order to prevent the air chambers from being completely clamped shut during a pressure loss.

6. The office, work and leisure chair according to claim 1, wherein the seat panel and the seat pad are connected to the hollow body by a wire cable or an adjustable progressive tension spring incorporated into the wire cable in order to lift and carry the office, work and leisure chair at the seat pad and, when fitted with a tension spring, regulate the rigidity of the wobble capability for different body weights as a result of pretensioning the air chambers by reducing a distance between the seat panel and the hollow body and thereby increasing the internal pressure in the air chambers.

7. The office, work and leisure chair according to claim 1, wherein the post between the cruciform base and the interface plate includes a pneumatic spring and height adjustment can be released by a push-pull cable system or a spring-loaded Bowden cable, wherein an associated actuating lever is arranged above the seat surface on an armrest or armrest support or underneath the seat surface.

8. The office, work and leisure chair according to claim 1, wherein a bottom plate of the hollow body rests on a base plate that is supported on the interface plate so as to be displaceable forward and backward via slide rails or roller tracks and the displaceability can be released by a push-pull cable system or a spring-loaded Bowden cable, wherein an associated actuating lever is arranged above the seat surface on an armrest or armrest support or underneath the seat surface.

9. The office, work and leisure chair according to claim 1, wherein an inclination of the backrest can be adjusted against a spring force, wherein the adjustability of the incline can be released by a push-pull cable system or a spring-loaded Bowden cable, and wherein an associated actuating lever is arranged above the seat surface on an armrest or armrest support or underneath the seat surface.

10. The office, work and leisure chair according to claim 1, comprising an electric power supply with an electronic circuit and piezoelectric or solenoid valves, which can be controlled by the circuit, installed in connecting lines between the plurality of air chambers realized in the form of air cushions, wherein each air cushion is equipped with a pressure sensor, and the seat panel has a receptacle slot for horizontally inserting a smartphone with an application that is associated with this office, work and leisure chair and serves for online acquisition of pressure sensor data and of inclinations and accelerations of the seat panel such that wobbling habits can be determined online by the application on the smartphone and stored in the data memory of the smartphone in order to generate individual wobble patterns, wherein these or other wobble patterns can be executed with the aid of the application by controlling the valves accordingly, and wherein the wobble patterns can be evaluated by the application, displayed on the smartphone and read out in a wireless fashion.

11. The office, work and leisure chair according to claim 1, wherein the seat panel is equipped with a two-layer or multilayer seat pad and comprises a lower, softer supporting layer and an upper, harder supporting layer, and the seat panel includes a peripheral, downwardly extending apron that protrudes downward beyond the interface plate and conceals the entire construction for realizing the wobble capability of the seat panel.

12. The office, work and leisure chair according to claim 1, wherein the backrest promotes subliminal movements in a back of the user, wherein said backrest comprises a central phoronomic element with a front column band and a rear column band, wherein the central phoronomic element extends upward from a center of a rear end of the seat surface, and wherein the central phoronomic element furthermore comprises a number of phoronomic elements that laterally protrude from a front column band of the central phoronomic element like ribs and respectively comprises two cross bands with connecting webs for supporting a back region of the seated person to both sides of the spinal column.

13. The office, work and leisure chair according to claim 12, wherein the central phoronomic element is configured to be resiliently inclined toward the rear with adjustable resistance and the front column band is configured to be bent so as to follow a contour of a spinal column wherein a length of the connecting webs from the rear column band is variable or adjustable in an articulated fashion or their coupling to an opposite inner side of the column bands is configured to be longitudinally displaced on the column bands such that these webs define a clearance between the column bands in a relaxed position and a shape and length of the front column band changes in accordance with an arrangement and design of the connecting webs when local pressure is exerted upon the front column band, wherein cross strips are integrally formed on and protrude from both sides of the front column band like ribs in order to support back sections of the seated person to both sides of the spinal column, wherein said cross strips are respectively connected to rear cross strips that are integrally formed on the front or rear column band by webs, and wherein these connecting webs are also length-variable or adjustable in an articulated fashion or their coupling to the cross strips are configured to be longitudinally displaced on said cross strips such that these webs define a clearance between the cross strips in the relaxed position and the shape and length of the front cross strips changes in accordance with the arrangement and design of the webs and said front cross strips close so as to adapt around the back of the person leaning against them when local pressure is exerted upon these front cross strips.

14. A retrofit kit for being installed on the non-wobbling seat surface of a conventional chair or on any seat surface and for thereby causing subliminal movements of the person sitting on the retrofit kit, wherein the retrofit kit comprises a seat panel, which is mounted with wobble capability and rests on multiple deformable air chambers that are connected to one another by connecting hoses and rest on an elastically deformable hollow body, wherein said hollow body operates as a pump for pumping up the air chambers every time a person sits down on the chair and once again fills with air due to elastic expansion of the hollow body every time a person stands up from the chair, wherein a pump hose with a one-way valve leads from the hollow body into at least one of the air chambers in order to compensate for any leakage losses, wherein the connecting hoses between the air chambers are equipped with valves configured to be opened and closed in a mechanically, hydraulically, pneumatically or electrically metered fashion such that the wobbling distance of the seat panel, as well as the damping of the wobbling motion, is variable, and wherein the bottom plate of the hollow body is mounted on a plate configured to be attached to a seat surface of a conventional office, work and leisure chair or to any seat surface.

15. The retrofit kit according to claim 14, wherein the base plate comprises a peripheral, downwardly protruding apron-like frame, wherein an interior of this frame is filled with a foam mass that can be cured by heat in order to realize a form-fitting adaptation to a contour of the seat surface of the conventional chair to be retrofitted.

16. The retrofit kit according to claim 14, wherein the air chambers are formed by multiple partition walls in an interior of a toroidal hose ring, wherein adjacent compartments are connected by the connecting hoses or, in the case of air chambers in the form of individual cushions, adjacent individual cushions are connected by the connecting hoses, and wherein the connecting hoses are connected to sliding or template valves or turning valves configured to be respectively actuated by a push-pull cable system or a Bowden cable.

17. The retrofit kit according to claim 14, wherein the air chambers are formed by multiple partition walls in the interior of a toroidal hose ring, wherein adjacent compartments are connected by the connecting hoses or, in the case of air chambers in the form of individual cushions, adjacent individual cushions are connected by the connecting hoses, the connecting hoses are connected to pinch valves, through which arc-shaped sections of the hoses extend, wherein these pinch valves comprise a guide ring that forms an upwardly open channel and a pinch ring that is rotatable therein about a center of the guide ring and comprises outer pinching surfaces that have a decreasing radius from the center in a rotating direction such that the hose sections protruding into the channel of the guide ring can be pinched between an inner side of an outer wall of the open channel of the guide ring and the pinching surfaces in a metered fashion and thereby opened and closed in a metered fashion by rotating the pinch ring against a spring force with the aid of a push-pull cable system or a Bowden cable, and dimensionally stable foam bodies are accommodated in the air chambers in order to prevent these air chambers from being completely clamped shut during a pressure loss.

18. The retrofit kit according to claim 14, wherein the seat panel is connected to the hollow body by a wire cable or an adjustable progressive tension spring incorporated into the wire cable in order to lift and carry the office, work and leisure chair at the seat pad and, when fitted with a tension spring, regulate the rigidity of the wobble capability for different body weights as a result of pretensioning the air chambers by reducing a distance between the seat panel and the hollow body and thereby increasing the internal pressure in the air chambers.

19. The retrofit kit according to claim 14, wherein the wobble-action seat panel has a receptacle slot for horizontally inserting a smartphone with an application that is associated with this office, work and leisure chair and serves for determining sitting habits of a person seated on the office, work and leisure chair in that wobbling motions are registered by the smartphone as a function of the time and can be evaluated and displayed by the application, as well as read out in a wireless fashion.

20. The retrofit kit according to claim 14, wherein the seat panel is equipped with a two-layer or multilayer seat pad that is realized similar to a laminate and comprises a lower, softer supporting layer and an upper, harder supporting layer, and the seat panel includes a peripheral, downwardly extending apron that protrudes downward beyond the interface plate and conceals the entire construction for realizing the wobble capability of the seat panel.

* * * * *